US010876758B2

(12) United States Patent
Pinkalla et al.

(10) Patent No.: US 10,876,758 B2
(45) Date of Patent: Dec. 29, 2020

(54) EXTERNALLY TENSIONED PLIABLE AIR DUCTS

(71) Applicant: Rite-Hite Holding Corporation, Milwaukee, WI (US)

(72) Inventors: Cary Pinkalla, Fox Point, WI (US); Jeff Logic, Racine, WI (US); Kevin J. Gebke, Dubuque, IA (US); Nicholas L. Kaufmann, Sherrill, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 16/278,378

(22) Filed: Feb. 18, 2019

(65) Prior Publication Data

US 2019/0285310 A1 Sep. 19, 2019

Related U.S. Application Data

(62) Division of application No. 15/474,751, filed on Mar. 30, 2017, now Pat. No. 10,208,981, which is a division of application No. 14/290,543, filed on May 29, 2014, now Pat. No. 9,644,858.

(51) Int. Cl.
*F16L 3/00* (2006.01)
*F24F 13/02* (2006.01)

(52) U.S. Cl.
CPC ..... *F24F 13/0218* (2013.01); *F24F 13/0254* (2013.01)

(58) Field of Classification Search
CPC .. F16L 3/11; F16L 3/14; F24F 13/0218; F24F 13/0254
USPC ..... 138/106, 107, 129, 130
See application file for complete search history.

(56) References Cited

U.S. PATENT DOCUMENTS

| | | | |
|---|---|---|---|
| 1,244,465 | A | 10/1917 | Braley |
| 1,261,008 | A | 4/1918 | Braley |
| 1,991,509 | A | 2/1935 | Kuballe |
| 2,091,265 | A | 8/1937 | Brown |
| 2,097,663 | A | 11/1937 | Hersey, Jr. et al. |
| 2,452,047 | A | 10/1948 | Hamblin |

(Continued)

FOREIGN PATENT DOCUMENTS

| | | |
|---|---|---|
| CN | 103210260 | 7/2013 |
| CN | 103958981 | 7/2014 |

(Continued)

OTHER PUBLICATIONS

International Searching Authority, "Search Report", issued in connection with PCT patent application No. PCT/US2015/031356, dated Dec. 14, 2015, 11 pages.

(Continued)

*Primary Examiner* — James F Hook
(74) *Attorney, Agent, or Firm* — Hanley, Flight & Zimmerman, LLC

(57) ABSTRACT

Example air duct assemblies include a pliable air duct supported such that the duct is maintained in a generally expanded shape even when the duct is deflated. In some examples, a series of hangers suspend the duct from one or more cables, tracks or other type of overhead support. The hangers are spaced apart and distributed over the length of the duct, and each one contributes in pulling the duct taut in the duct's longitudinal direction.

20 Claims, 15 Drawing Sheets

(56) References Cited

U.S. PATENT DOCUMENTS

| | | | | |
|---|---|---|---|---|
| 2,804,095 | A * | 8/1957 | Schauenburg | E21F 1/04 138/107 |
| 2,895,510 | A * | 7/1959 | Rebut | F16L 11/00 138/107 |
| 3,143,146 | A * | 8/1964 | Kennedy | B67D 7/002 138/107 |
| 3,520,244 | A | 7/1970 | Gaines, Jr. | |
| 3,857,590 | A * | 12/1974 | Meeker | F16L 13/00 285/305 |
| 4,625,631 | A | 12/1986 | Vera | |
| 4,944,973 | A | 7/1990 | Follette | |
| 5,137,057 | A | 8/1992 | Hummert, III | |
| 5,285,818 | A | 2/1994 | Hummert, III | |
| 5,429,330 | A | 7/1995 | Bond et al. | |
| 5,664,607 | A | 9/1997 | Van Wassenhove | |
| 5,685,076 | A | 11/1997 | Curley et al. | |
| 5,989,006 | A | 11/1999 | Godeau et al. | |
| 6,280,320 | B1 | 8/2001 | Paschke et al. | |
| 6,354,937 | B1 | 3/2002 | Crook | |
| 6,425,417 | B1 | 7/2002 | Paschke | |
| 6,427,727 | B1 * | 8/2002 | Thomas | F16L 11/16 138/106 |
| 6,557,589 | B2 * | 5/2003 | Bozic | F16L 3/00 138/106 |
| 8,434,526 | B1 | 5/2013 | Pinkalla et al. | |
| 9,644,858 | B2 | 5/2017 | Pinkalla et al. | |
| 9,784,469 | B2 | 10/2017 | Ramos et al. | |
| 10,066,850 | B2 | 9/2018 | Pinkalla et al. | |
| 10,208,981 | B2 * | 2/2019 | Pinkalla | F24F 13/0254 |
| 2002/0179169 | A1 * | 12/2002 | Shanfelt | E03F 1/008 138/129 |
| 2003/0106895 | A1 * | 6/2003 | Kalal | B65D 81/3893 220/9.2 |
| 2008/0113610 | A1 | 5/2008 | Brown et al. | |
| 2009/0194186 | A1 | 8/2009 | Gross | |
| 2009/0260706 | A1 * | 10/2009 | Hesse | F16L 11/042 138/144 |
| 2010/0048121 | A1 | 2/2010 | Klopfenstein et al. | |
| 2012/0028562 | A1 | 2/2012 | Heim et al. | |
| 2012/0125472 | A1 | 5/2012 | Pinkalla et al. | |
| 2013/0112305 | A1 | 5/2013 | Pinkalla et al. | |
| 2014/0000744 | A1 | 1/2014 | Pinkalla et al. | |

FOREIGN PATENT DOCUMENTS

| | | |
|---|---|---|
| DE | 286851 | 2/1991 |
| EP | 1091179 | 4/2001 |
| EP | 3255354 | 12/2017 |
| EP | 3267122 | 1/2018 |
| FR | 2742523 | 6/1997 |
| JP | 2004116793 | 4/2004 |
| WO | 0104547 | 1/2001 |

OTHER PUBLICATIONS

International Searching Authority, "Written Opinion", issued in connection with PCT patent application No. PCT/US2015/031356, dated Dec. 14, 2015, 16 pages.

Prihoda, "Fabric Ducting & Diffusers", technical brochure, USA version Jan. 2014, 32 pages.

Berner International Corporation, "(Posi-Flow) Installation Instructions Models PFT-XD & PFT XHD Air Control Duct", No. 11-886, dated May 1996, 3 pages.

QDUCT "Q-DUCT Installation Instructions", retrieved from www.qduct.com/install_instyructions_html., dated Jun. 3, 1999, 7 pages.

European Patent Office "Search Report", issued in connection with the European Application No. 17001033.4 dated Mar. 20, 2018, 10 pages.

Canadian Intellectual Property Office, "Office Action", issued in connection with the Canadian Application No. 2947481, dated Jun. 29, 2018, 3 pages.

European Patent Office "Invitation Pursuant to Rule 62a(1) EPC", issued in connection with the European Application No. 17001033.4, dated Nov. 13, 2017, 2 pages.

European Patent Office "Search Report", issued in connection with the European Application No. 17001035.9, dated Nov. 15, 2017, 5 pages.

Canadian Intellectual Property Office, "Office Action", issued in connection with the Canadian Application No. 2947481, dated Sep. 26, 2017, 5 pages.

IP Australia, "Notice of Acceptance", issued in connection with Australian Patent Application No. 2015267395, dated Sep. 26, 2017, 4 pages.

IP Australia, "Examination Report No. 1", issued in connection with Australian Patent Application No. 2015267395, dated Jun. 30, 2017, 5 pages.

International Searching Authority, "International Preliminary Report on Patentability", issued in connection with PCT patent application No. PCT/US2015/031356, dated Nov. 29, 2016, 17 pages.

IP Australia, "Examination Report No. 2", issued in connection with Australian Patent Application No. 2017216537, dated Aug. 23, 2018, 3 pages.

IP Australia, "Examination Report No. 1", issued in connection with Australian Patent Application No. 2017216537, dated Mar. 9, 2018, 4 pages.

IP Australia, "Examination Report No. 1", issued in connection with Australian Patent Application No. 2017268596, dated Jun. 8, 2018, 3 pages.

IP Australia, "Examination Report No. 2", issued in connection with Australian Patent Application No. 2017268596, dated Mar. 8, 2019, 4 pages.

IP Australia, "Examination Report No. 3", issued in connection with Australian Patent Application No. 2017268596, dated May 24, 2019, 3 pages.

China National Intellectual Ptrperty Administration, "Search Report" issued in connection with Chinese Patent Application No. 201580028482.4, dated Feb. 20, 2019, 14 pages.

International Searching Authority, "Invitation to pay additional fees and, where applicable, protest fee", issued in connection with PCT patent application No. PCT/US2015/031356, dated Aug. 12, 2015, 8 pages.

IP Australia, "Notice of Acceptance", issued in connection with Australian Patent Application No. 2017268596, dated Jun. 12, 2019, 4 pages.

Intellectual Property India, "Examination Report", issued in connection with the Indian Application No. 201617038203, dated Jun. 13, 2019, 7 pages.

China National Intellectual Property Administration, "Notice of Granting Patent Right for Invention," issued in connection with Chinese patent application No. 201580028482.4, dated Dec. 18, 2019, (4 pages).

China National Intellectual Property Administration, "Second Office Action" issued in connection with Chinese application No. 201580028482.4, dated Sep. 23, 2019, 4 pages.

Canadian Intellectual Property Office, "Notice of Allowance," issued in connection with Canadian Patent Application No. 2,947,481, dated Feb. 28, 2020, (1 page).

United States Patent and Trademark Office, "Notice of Allowance and Fee(s) Due," issued in connection with U.S. Appl. No. 15/474,751, dated Oct. 4, 2018, (5 pages).

United States Patent and Trademark Office, "Non-Final Office Action," issued in connection with U.S. Appl. No. 15/474,751, dated Feb. 8, 2018, (9 pages).

United States Patent and Trademark Office, "Notice of Allowance and Fee(s) Due," issued in connection with U.S. Appl. No. 14/290,543 dated Jan. 20, 2017, (21 pages).

United States Patent and Trademark Office, "Final Office Action," issued in connection with U.S. Appl. No. 14/290,543, dated Nov. 15, 2016, (13 pages).

United States Patent and Trademark Office, "Notice of Allowance and Fee(s) Due," issued in connection with U.S. Appl. No. 15/243,047, dated May 2, 2018, (8 pages).

(56) References Cited

OTHER PUBLICATIONS

United States Patent and Trademark Office, "Non-Final Office Action," issued in connection with U.S. Appl. No. 15/243,047, dated Sep. 26, 2017, (29 pages).
United States Patent and Trademark Office, "Election/Restrictions," issued in connection with U.S. Appl. No. 14/290,543, dated Feb. 26, 2016, (7 pages).
United States Patent and Trademark Office, "Non-Final Office Action," issued in connection with U.S. Appl. No. 14/290,543, dated Jul. 13, 2016, (11 pages).
IP Australia, "Examination Report," issued in connection with Australian patent application No. 2019205979, dated May 8, 2020, (8 pages).
European Patent Office, "Intention to Grant," issued in connection with European patent application No. 15727172.7, dated Jun. 23, 2020, (49 pages).
European Patent Office, "Communication pursuant to Article 94(3) EPC," issued in connection with European patent application No. 17001033.4, dated Aug. 28, 2020, (4 pages).
European Patent Office, "Communication pursuant to Article 94(3) EPC," issued in connection with European patent application No. 17001035.9, dated Aug. 28, 2020, (4 pages).

* cited by examiner

EXTERNALLY TENSIONED PLIABLE AIR DUCTS

RELATED APPLICATION

This patent arises from a divisional of U.S. application Ser. No. 15/474,751 (now U.S. Pat. No. 10,208,981), which was filed on Mar. 30, 2017, and which claims priority to U.S. application Ser. No. 14/290,543 (now U.S. Pat. No. 9,644,858), which was filed on May 29, 2014. U.S. application Ser. No. 15/474,751 and U.S. application Ser. No. 14/290,543 are hereby incorporated herein by reference in their entireties.

FIELD OF THE DISCLOSURE

The present disclosure relates generally to air ducts and more specifically to inflatable air ducts.

BACKGROUND

Ductwork is often used to convey conditioned air (e.g., heated, cooled, filtered, humidified, dehumidified, etc.) discharged from a fan and to distribute the air to a room or other areas within a building. Ducts are typically formed of generally self-supporting sheet metal, such as steel, aluminum, or stainless steel. Some ducts, however, are made of pliable materials, such as fabric or flexible plastic sheeting.

Pliable ducts are often suspended from a horizontal cable or track by way of a series of connectors distributed along the length of the duct. The connectors may include snap-hooks, clips, rings, or other type of connector that can slide along the cable or track. The connectors preferably allow the fabric duct to be readily removed from its cable or track so that the fabric duct can be cleaned.

When a fan or blower forces air through a pliable duct to supply the room with air, the pressure of the forced air tends to inflate the duct. This can cause the duct to expand radially and longitudinally to a generally cylindrical shape. When the ventilating or other conditioning demand of the room is satisfied, the blower is usually turned off, which allows the duct to deflate and retract lengthwise.

DETAILED DESCRIPTION

Figure 1:
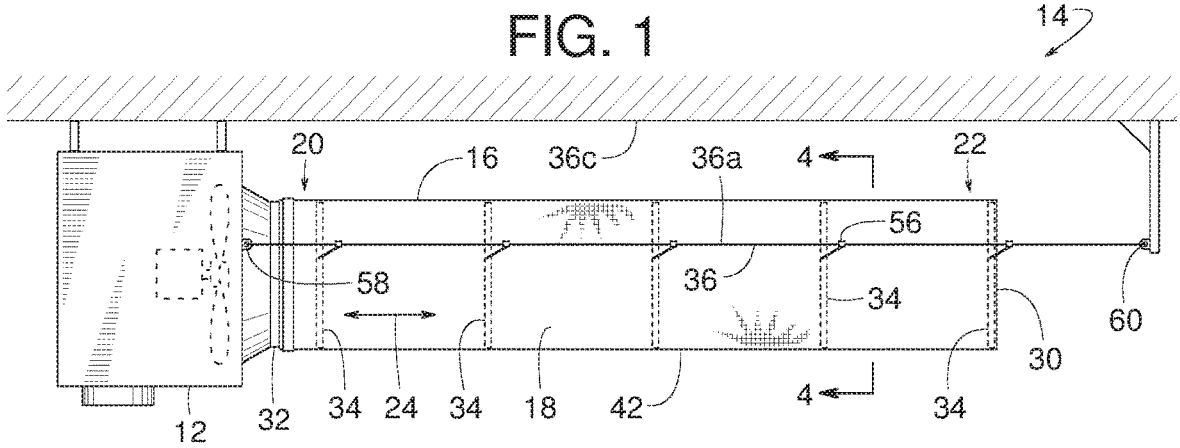
FIG. 1 is a side view of an example air duct assembly constructed in accordance with the teachings disclosed herein.

Depending on the application and material of the duct, in some cases, a deflated pliable duct sags, which may create a poor appearance or interfere with whatever might be directly beneath the duct. If a blower rapidly inflates the duct, rapid expansion of the duct may create an objectionable snapping or popping sound as the duct suddenly becomes taut.

FIGS. 1-38 show various views of example air duct assemblies comprising a pliable tubular sidewall that receives air 10 discharged from a blower 12 and then conveys air 10 to a room or other areas of a building. Turning the blower 12 on and off, as needed, repeatedly places the duct selectively in an inflated state (e.g., FIGS. 2, 7, 32 and 34) and a deflated state (e.g., FIGS. 1, 3-6, 8-17, 22-30, 33, 35, 38 and 39). To provide the example ducts with an inflated appearance even when deflated, each of the example ducts includes means for holding a deflated duct's pliable sidewall in a generally inflated shape.

The term, "pliable" refers to a material that can be readily folded over onto itself and later unfolded and restored to its original shape without appreciable damage to the material. Fabric is one example of a pliable material, and sheet metal is an example of a material that is not pliable. The term, "inflated state" refers to an air duct that is pressurized, and the term, "deflated state" refers to an air duct that is depressurized. According to these definitions, the interior of the duct is at least slightly more expanded (longitudinally or radially) in the inflated state as compared to the deflated state.

In the example shown in FIGS. 1-4, an example air duct assembly 14 comprises an air duct 16 that includes a pliable tubular sidewall 18 with an upstream end 20 at the blower 12 and a downstream end 22, wherein the terms, "upstream" and "downstream" are with respect to air 10 flowing in a longitudinal direction 24 within an interior 26 of the air duct 16. In some examples, porosity and/or other openings in the sidewall 18 allow the air 10 within the duct's interior 26 to disperse into an external area 28 outside of the duct 16. In some examples, an end cap 30, in some examples made of a material similar to that of the sidewall 18, blocks off the duct's downstream end 22.

In the illustrated example, the duct's upstream end 20 is supported by a discharge flange and/or blower flange 32 of the blower 12, and the rest of the duct 16 is supported by various support structure. Examples of such support structure include, but are not limited to, a hoop 34 within the duct's interior 26, an overhead support member 36, and at least one hanger 38 coupling the overhead support member 36 to at least one of the following: the sidewall 18, the hoop 34 and/or a loop 40 that holds the hoop 34 to the sidewall 18. The term "loop" refers to any structure at least partially disposed within the interior of a pliable-wall air duct, wherein the structure captures and holds an internal hoop at a desired position within the duct.

The term, "overhead support member" refers to any structure for carrying at least some weight of the sidewall 18. In some examples, the overhead support member extends at least higher than a lowermost surface 42 of the sidewall 18. Examples of the overhead support member 36 include, but are not limited to a cable 36*a*, a wire, a strap, a chain, a bar, a rod, a track 36*b* (FIG. 30), a beam, a ceiling 36*c*, and various combinations thereof.

The hoop 34 is any structure that helps hold the sidewall 18 expanded at least when the blower 12 is de-energized. In the examples illustrated in FIGS. 1-5, the hoop 34 comprises an outer rim 44, a central region 46 (e.g., a hub), and one or more spokes 48 (any number of spokes) that helps maintain the hoop's circular or other predetermined shape. In some examples, the hoop 34 only includes the outer rim 44 without spokes or a hub. In some examples, the hoop 34 is made of metal, such as steel or aluminum.

Figure 3:
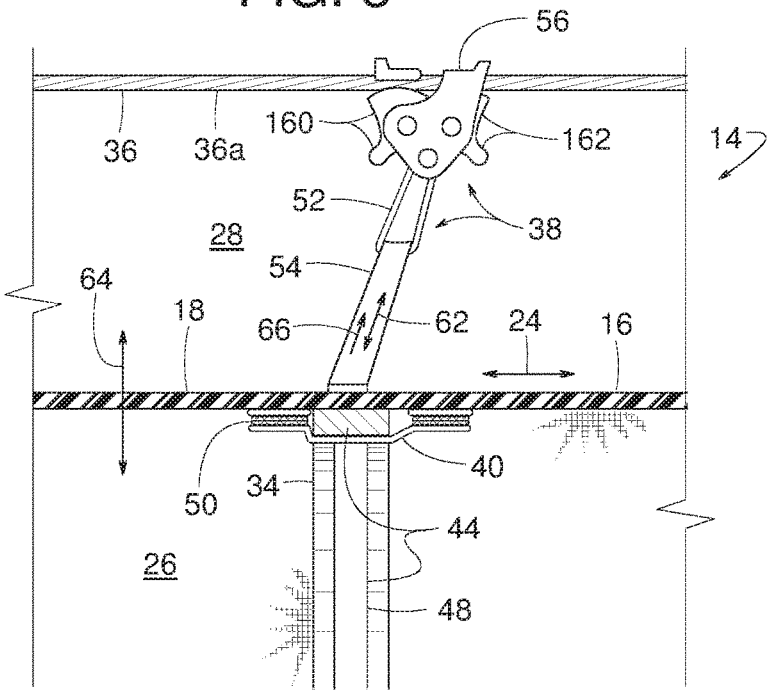
FIG. 3 is a cross-sectional view taken along line 3-3 of FIG. 1.
Figure 4:
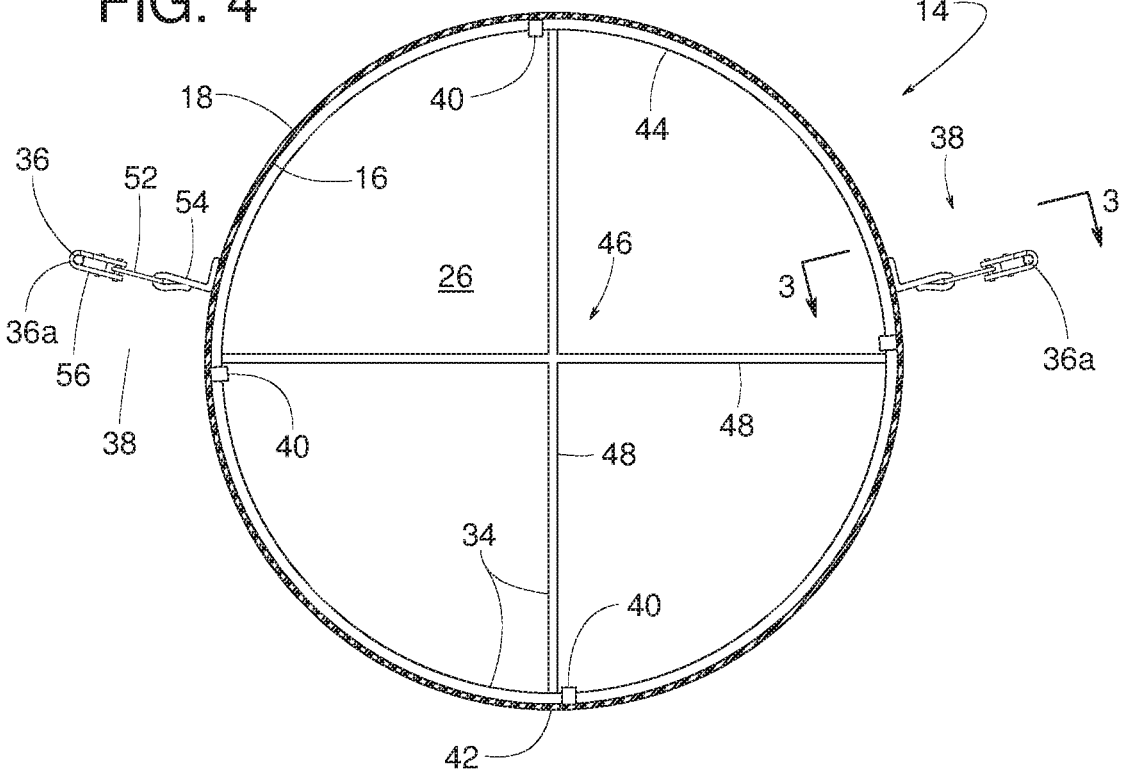
FIG. 4 is a cross-sectional view taken along line 4-4 of FIG. 1.
Figure 5:
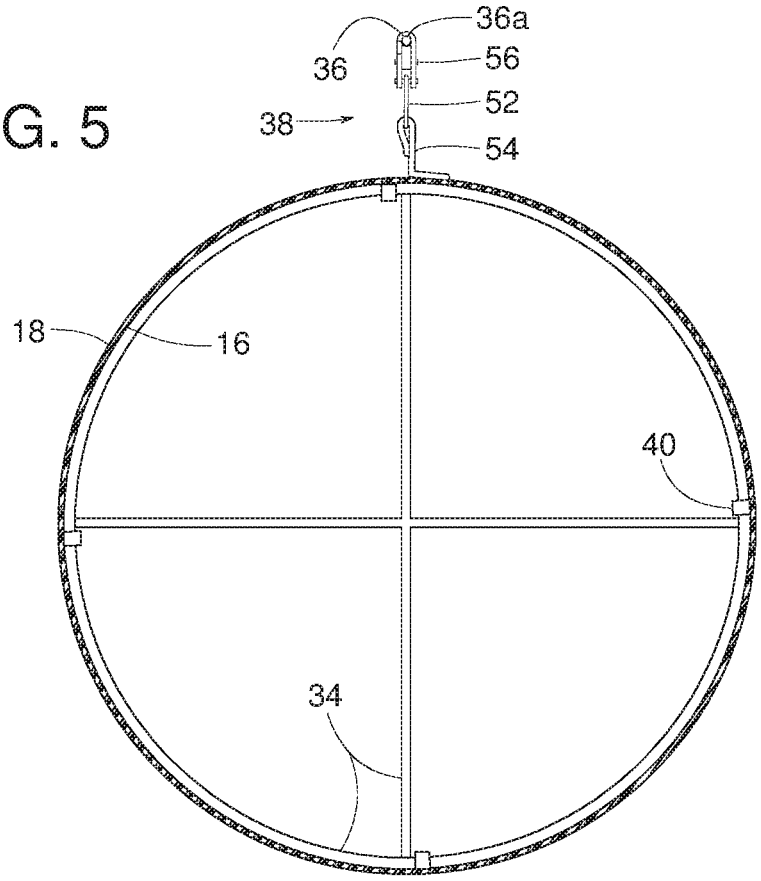
FIG. 5 is a cross-sectional view similar to FIG. 4 but showing another example hanger arrangement constructed in accordance with the teachings disclosed herein.
Figure 6:
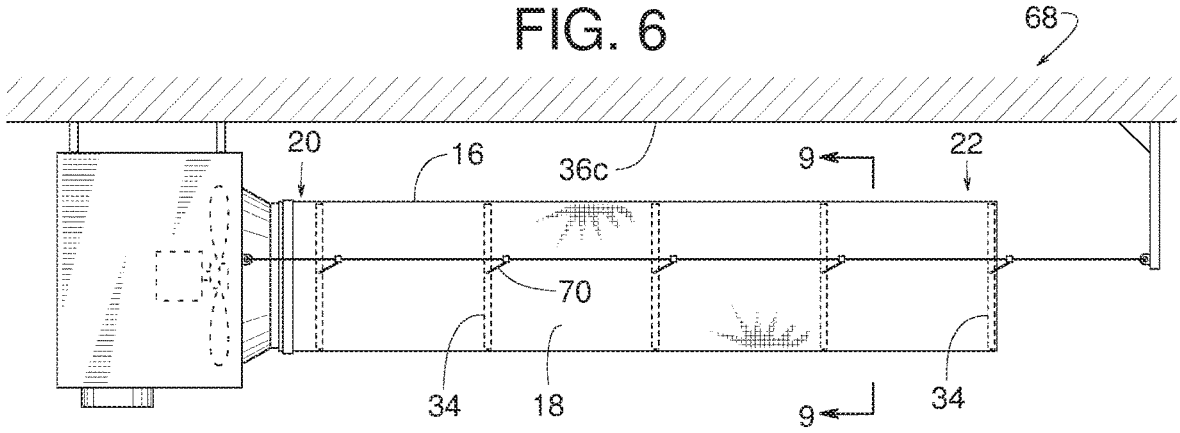
FIG. 6 is a side view of another example air duct assembly constructed in accordance with the teachings disclosed herein.
Figure 7:
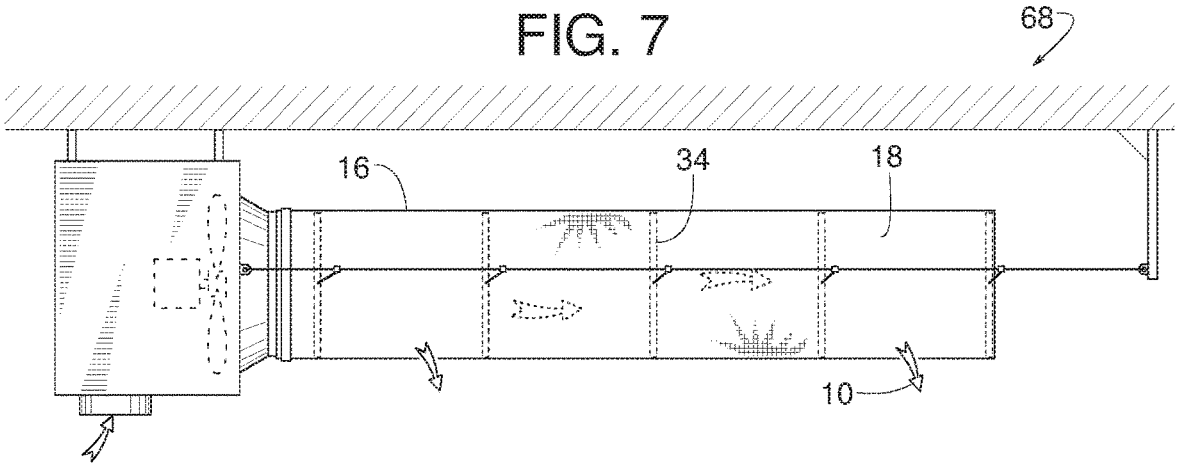
FIG. 7 is a side view similar to FIG. 6 but showing the duct inflated.
Figure 8:
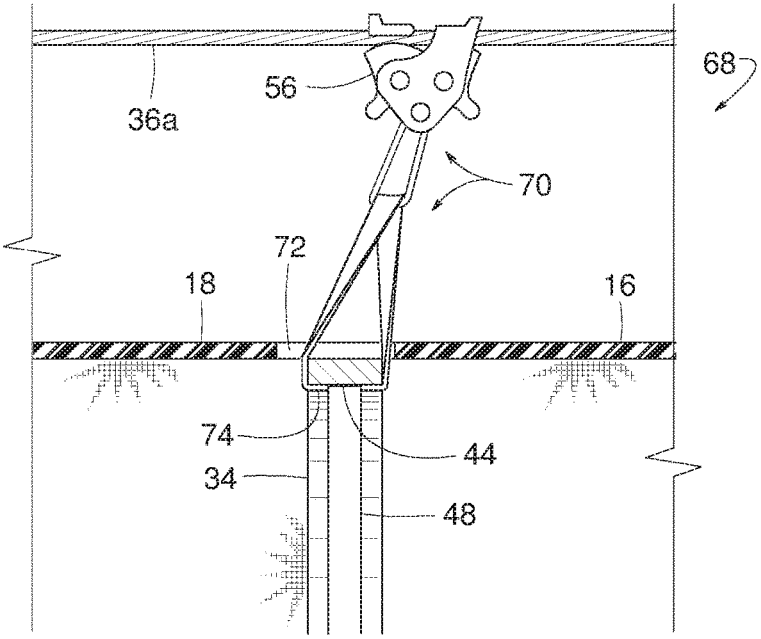
FIG. 8 is a cross-sectional view taken along line 8-8 of FIG. 9.
Figure 9:
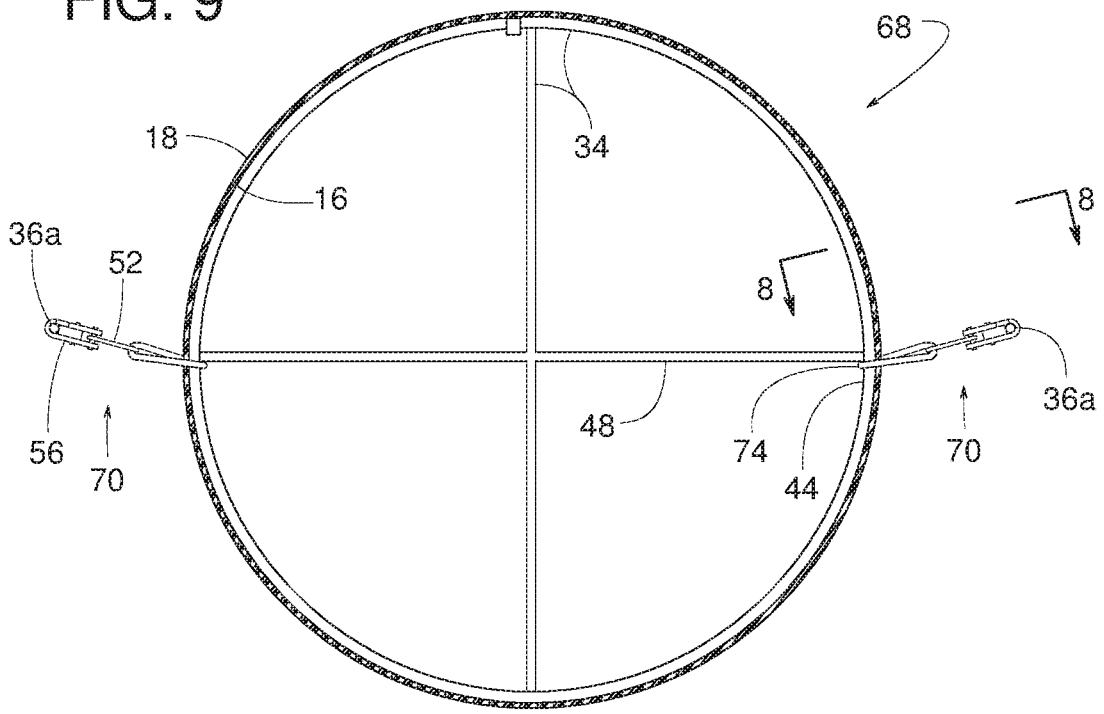
FIG. 9 is a cross-sectional view taken along line 9-9 of FIG. 6.

FIG. 3-5 show loops 40 being used for holding the hoops 34 in their proper position within the duct 16. In this example, the proper positioning is with respect to the hoop's axial location along the duct's length (the longitudinal direction 24) and/or the hoop's perpendicularity relative to the longitudinal direction 24. In the illustrated example, the loops 40 are made of a pliable material that captures the hoop's outer rim 44 and is removably attached to the sidewall 18 by way of a hook-and-loop fastener 50 (e.g., VELCRO fastener, wherein VELCRO is a registered trademark of Velcro Industries Company of Amsterdam, Netherlands). Other examples of the loops 40 are made of different materials, including rigid materials, and are attached by means other than the fastener 50 such as, for example, snaps, bolts, glue, etc. Some example loop materials include, but are not limited to, metal, plastic and/or fabric. In some examples, the loop 40 is a partial loop in the shape of a relatively rigid or resilient hook or clip.

Figure 2:
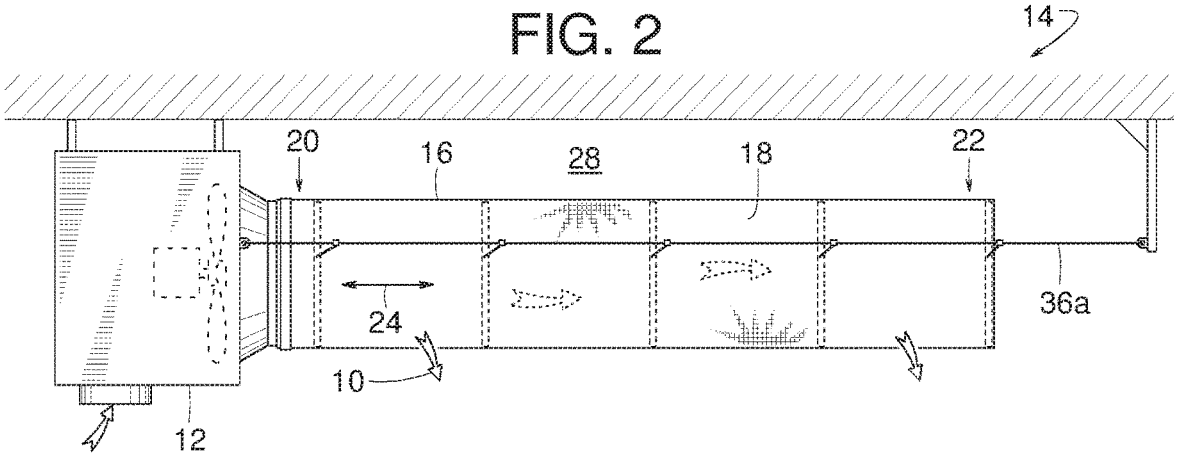
FIG. 2 is a side view similar to FIG. 1 but showing the duct inflated.

In FIGS. 1 and 2, the hanger 38 is schematically illustrated to represent any structure for transmitting at least some of the duct's weight and/or the weight of the hoop 34 to the overhead support member 36. Examples of the hanger 38 include, but are not limited to, a strap, a cable, a wire, a chain, a bar, a rod, a bracket, a hook, a cable clamp, a track clamp, and/or various combinations thereof. In some examples, the hanger 38 includes features shown in FIGS. 32-35 and as disclosed in US Patent Application Publication 2008/0113610 A1, which is incorporated herein by reference in its entirety.

FIG. 3 shows the hanger 38 comprising a cable 52, a strap 54, and a cable clamp 56 that together connect the duct 16 to the cable 36*a* (one example of overhead support member 36). In this example, the strap 54 is sewn or otherwise attached to the sidewall 18. The cable 52 couples the strap 54 to the cable clamp 56. And the cable clamp 56 includes means for gripping the cable 36*a* to inhibit the cable clamp's movement along the cable 36*a*. Although the cable clamp 56 could be any device with means for gripping the cable 36*a*

(e.g., a clamp), the illustrated example cable clamp 56 is a ⅛-inch Gripple C-Clip provided by Gripple Inc. of Aurora, Ill.

Referring to the dual-cable example illustrated in FIGS. 1-4, each cable 36*a* is installed and held taut between two convenient anchor points 58 and 60. The cables 36*a* extend along and/or are radially spaced about the duct 16 (e.g., at a 2:30 position and a 9:30 position). A plurality of hoops 34 are distributed along the length of the duct 16. In some examples, one hoop 34 is installed at the very end of the duct 16 at the downstream end 22. The cable clamps 56 are manually pulled forward away from the point 58 toward the point 60 and then clamped or gripped in place such that the hangers 38 are in tension. In the illustrated example, one or more of the cable clamps 56 are independently adjustable relative to the longitudinal axis of the duct 16. Thus, the straps 54 that are coupled to the same hoop 34, for example, may be coupled at different longitudinal locations along the respective cables 36*a*. The hangers 38 may be radially spaced and/or longitudinally spaced about the duct 16. The tension in the hangers 38 pulls the sidewall 18 taut in the longitudinal direction 24 so that generally the full length of the sidewall 18 tends to follow the shape of the hoop's outside diameter, regardless of whether the duct 16 is inflated or deflated. More specifically, the hanger 38 is elongate in a tilted direction 62 that is angularly displaced out of collinear alignment with both the longitudinal direction 24 and a radial direction 64 (the radial direction 64 being substantially perpendicular to the longitudinal direction 24). In other words, the tilted direction 62 is neither parallel to nor perpendicular to the longitudinal direction 24. Along the tilted direction 62, the hanger 38 transmits a pulling force 66 that subjects the sidewall 18 to tension in the longitudinal direction 24. Such a configuration enables the hangers 38 to both support the weight of the duct 16 in a vertical direction and hold it taut in the longitudinal direction 24.

In addition or alternatively, the hangers 38 can suspend the duct 16 from a single overhead cable 36*a* (or other overhead support member), as shown in FIG. 5. In this example, the hangers 38 are still tilted in a manner similar to the example shown in FIG. 3. Thus, such a tilted configuration enables the hangers 38 to both support the weight of the duct 16 and hold it taut in the longitudinal direction 24. Without two support cables 36*a*, however, additional structure might be helpful in maintaining each hoop's substantial perpendicularity relative to the longitudinal direction 24.

Figure 10:
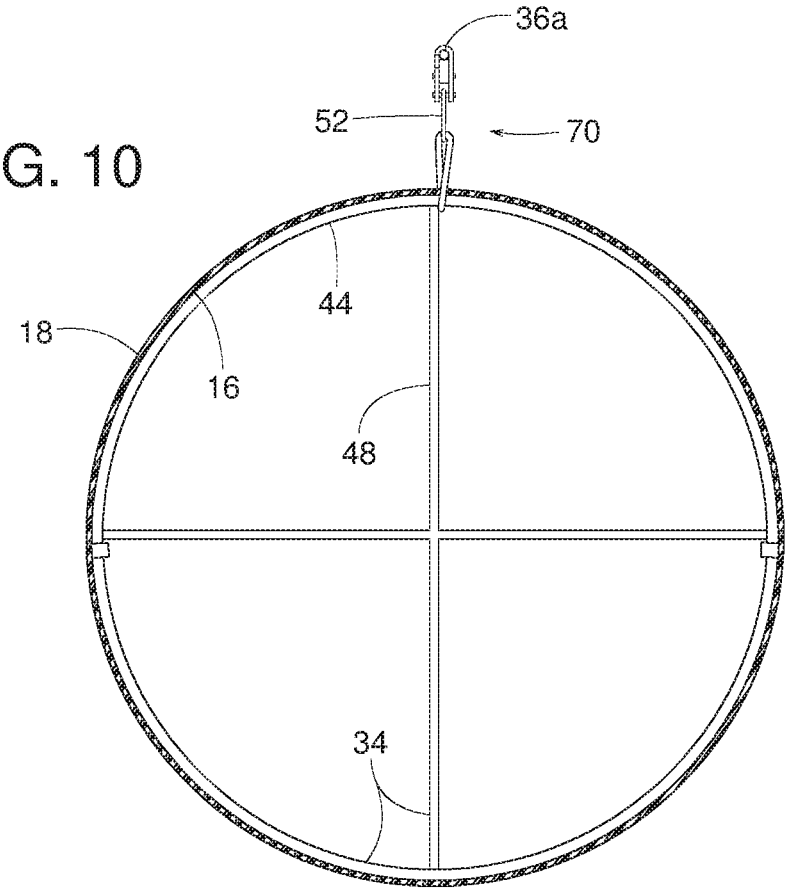
FIG. 10 is a cross-sectional view similar to FIG. 9 but showing another example hanger arrangement constructed in accordance with the teachings disclosed herein.

In addition or alternatively, referring to an example air duct assembly 68 of FIGS. 6-9, some hangers 70 pass through an opening 72 in the sidewall 18 and include a loop 74 that captures and/or is coupled to the outer rim 44 and/or the spoke 48 to hold and/or retain the hoop 34 with respect to the sidewall 18. Otherwise, the structure and function of the air duct assemblies 14 and 68 are substantially similar. In addition or alternatively, the hangers 70 can suspend the duct 16 from a single overhead cable 36*a* (or other overhead support member), as shown in FIG. 10, which corresponds to the example shown in FIG. 5.

Figure 11:
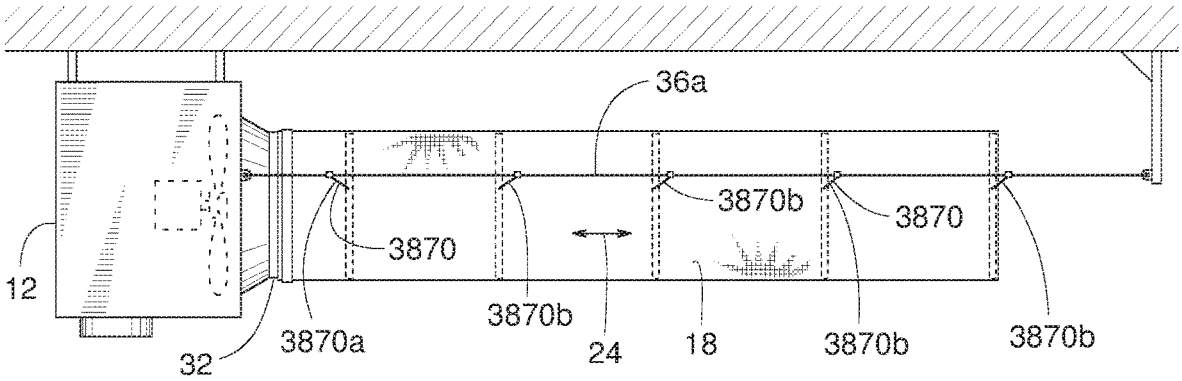
FIG. 11 is a side view similar to FIG. 1 but showing another example air duct assembly constructed in accordance with the teachings disclosed herein.
Figure 12:
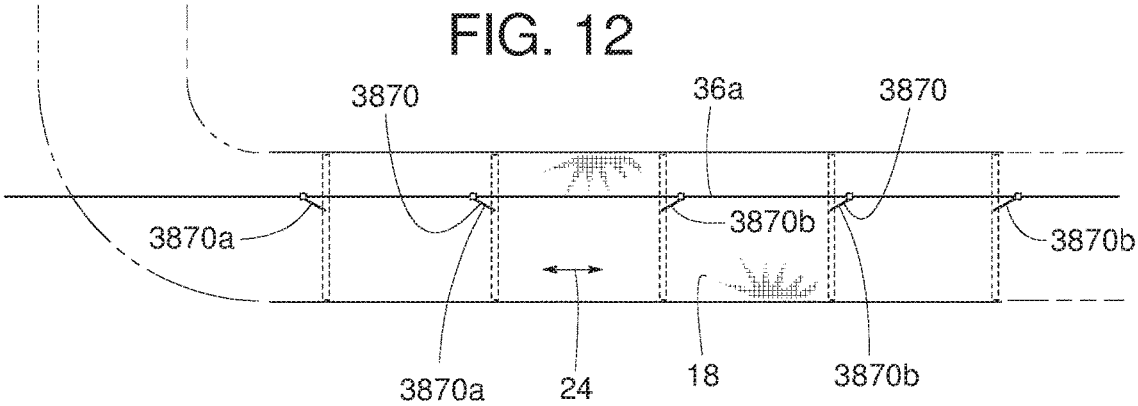
FIG. 12 is a side view of another example air duct assembly constructed in accordance with the teachings disclosed herein.

Although the hangers 38 and 70 of FIGS. 1-10, are all shown pulling in the same direction away from the blower flange 32, some examples of the hangers 38 and 70 pull in opposite directions. FIGS. 11 and 12, for instance, show the hangers 3870 (e.g., the hanger 38 or 70) pulling in opposite directions along the longitudinal direction 24 to hold the sidewall 18 taut between the hangers 3870 without having to necessarily rely on support from the blower flange 32. FIGS. 11 and 12 show the hangers 3870*a* pulling the sidewall 18 to the left (as viewed in the drawing figures) and the hangers 3870*b* pulling to the right. Without requiring support from the blower flange 32, the sidewall 18 can connect to almost any imaginable structure, examples of which include, but are not limited to, a duct curved or angled to the right, a duct curved or angled to the left, a duct curved or angled upward, a duct curved or angled downward, a straight section of duct, a duct of larger cross-sectional area, a duct of smaller cross-sectional area, a T-connection, a Y-connection, etc.

Figure 13:
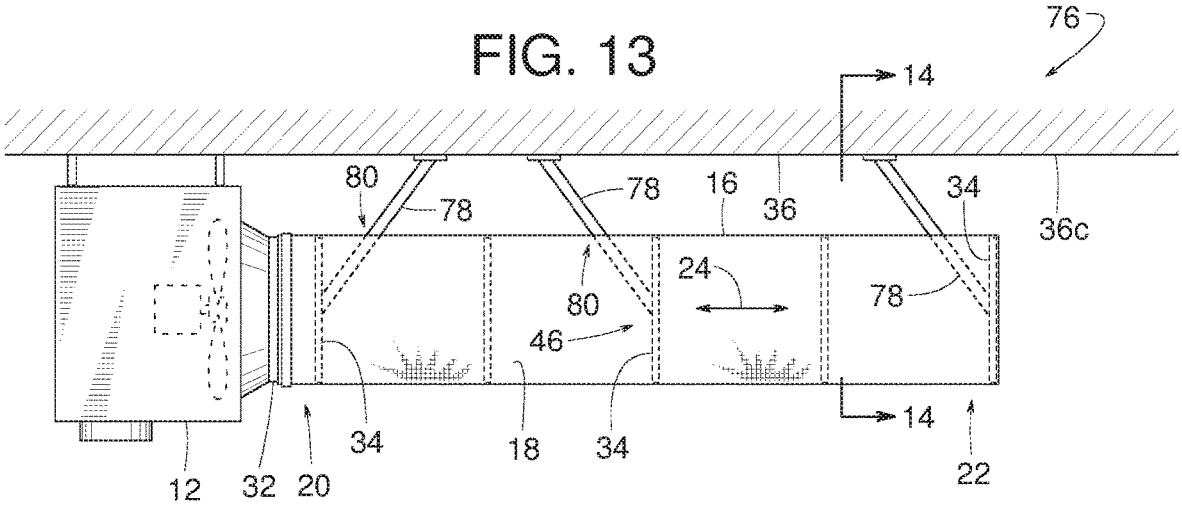
FIG. 13 is a side view of another example air duct assembly constructed in accordance with the teachings disclosed herein.
Figure 14:
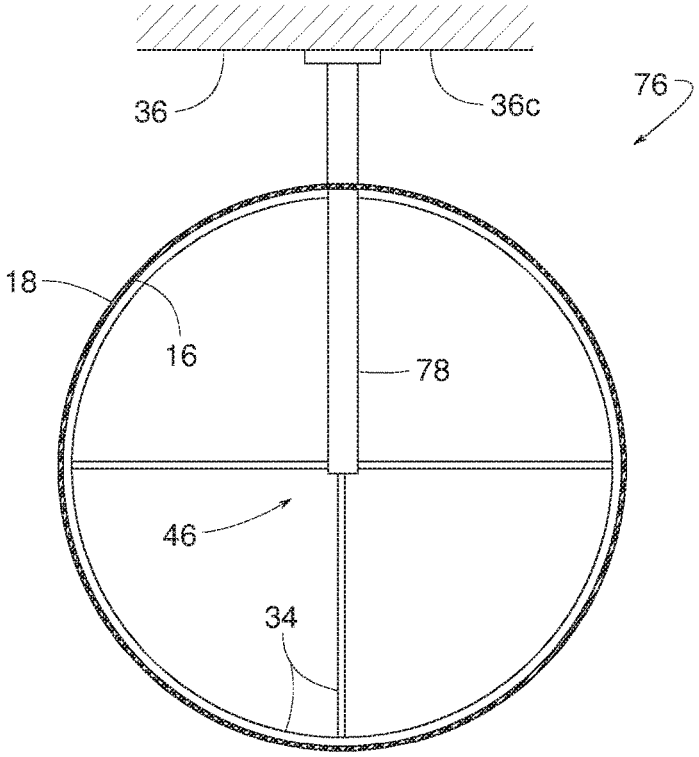
FIG. 14 is a cross-sectional view taken along line 14-14 of FIG. 13.
Figure 15:
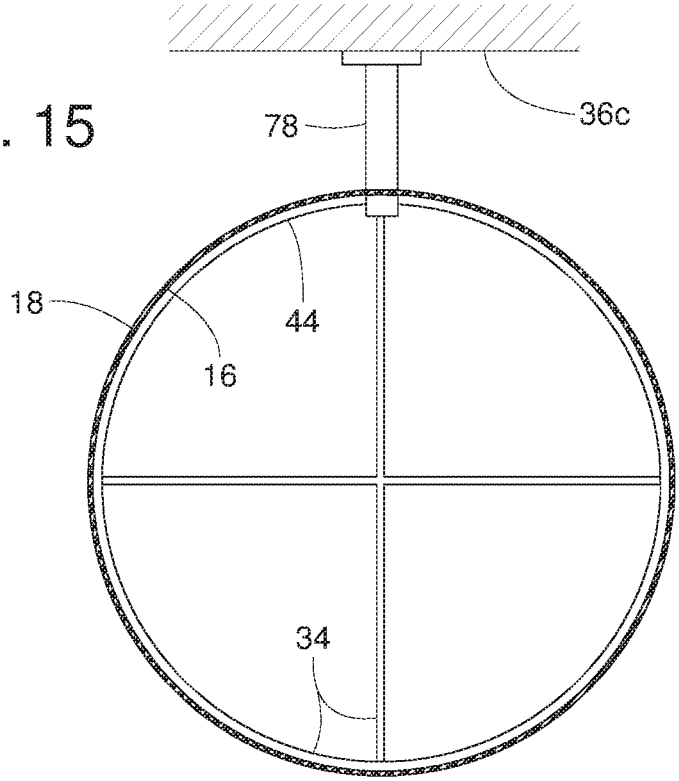
FIG. 15 is a cross-sectional view similar to FIG. 14 but showing an alternate example bracket constructed in accordance with the teachings disclosed herein.
Figure 16:
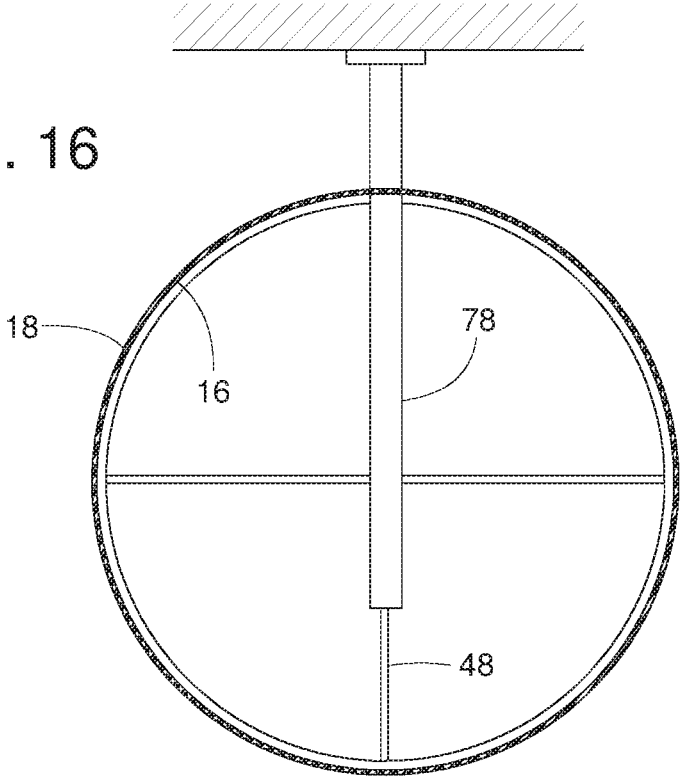
FIG. 16 is a cross-sectional view similar to FIG. 15 but showing another example bracket constructed in accordance with the teachings disclosed herein.

FIGS. 13 and 14 show an example air duct assembly 76 similar to air duct assembly 14 of FIGS. 1-4; however, instead of the cables 36*a* and the hangers 38 suspending the air duct 16, one or more relatively rigid brackets (e.g., metal brackets, hard plastic brackets, etc.) 78 pass through an opening 80 in the sidewall 18 to anchor the hoops 34 to the overhead support member 36 (e.g., ceiling, beam, truss, etc.). A lower end of the bracket 78 can be attached to the hoop 34 at various points, examples of which include, but are not limited to, at the central region 46 (FIGS. 13 and 14), at the outer rim 44 (FIG. 15), and at the spoke 48 (FIG. 16). In some examples, the bracket 78 is non-adjustably coupled to the hoop 34. As set forth herein, non-adjustably means that the bracket 78 is fixed to the hoop 34. The brackets 78 being more rigid than the sidewall 18 enables the bracket 78 to hold the hoop 34 generally perpendicular relative to the longitudinal direction 24. The strength and rigidity of the brackets 78 also enable the brackets 78, in some examples, to urge the hoops 34 in a direction away from the blower flange 32 to hold the sidewall 18 taut longitudinally. Some example duct assemblies do not rely on the blower flange 32 to help hold the sidewall 18 taut. For instance, in some examples, the brackets 78 urge their respective hoops 34 in opposite directions along the longitudinal direction 24 to hold the sidewall 18 taut between the two hoops 34 rather than between the hoop 34 and the blower flange 32. The brackets 78 can be of any suitable configuration including, but not limited to, tilted (e.g., as shown in FIG. 13), vertical (e.g., substantially perpendicular to longitudinal direction 24), and horizontal (substantially perpendicular to longitudinal direction 24). As used herein, substantially perpendicular means within +/−one degree of perpendicular. As used herein, substantially parallel means within +/−one degrees of parallel.

Figure 17:
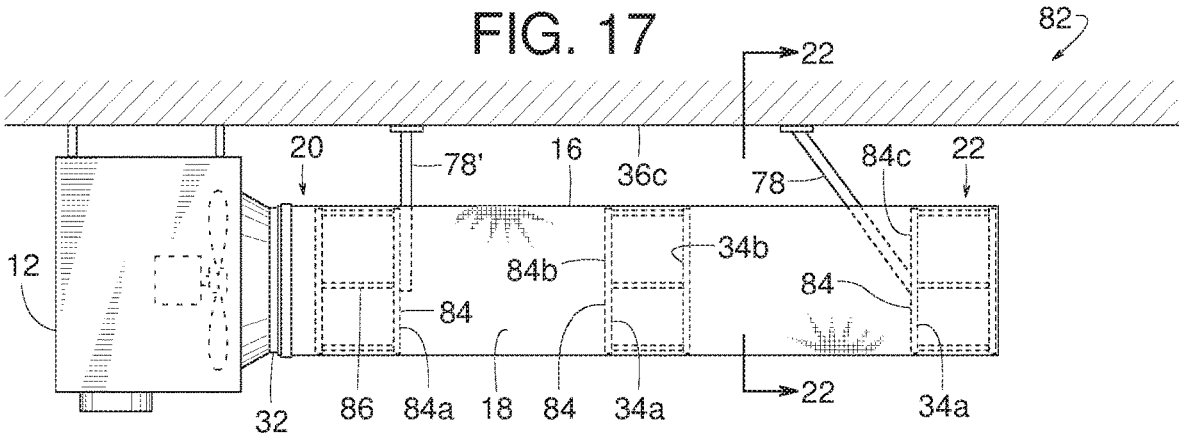
FIG. 17 is a side view of another example air duct assembly constructed in accordance with the teachings disclosed herein.
Figure 18:
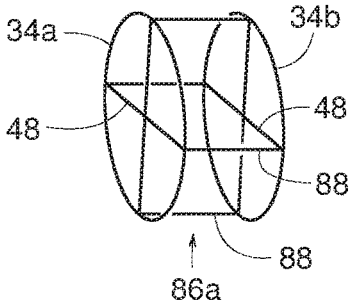
FIG. 18 is a schematic perspective view of an example dual-hoop structure constructed in accordance with the teachings disclosed herein.
Figure 19:
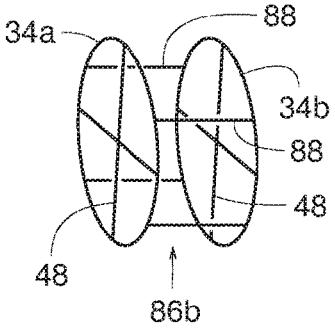
FIG. 19 is a schematic perspective view of another example dual-hoop structure constructed in accordance with the teachings disclosed herein.
Figure 20:
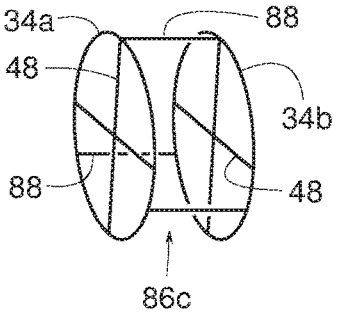
FIG. 20 is a schematic perspective view of another example dual-hoop structure constructed in accordance with the teachings disclosed herein.
Figure 21:
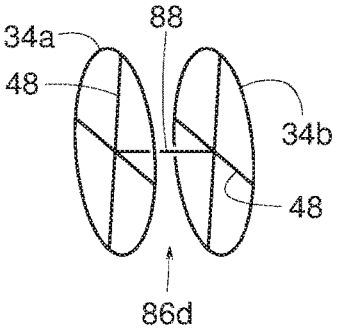
FIG. 21 is a schematic perspective view of another example dual-hoop structure constructed in accordance with the teachings disclosed herein.
Figure 22:
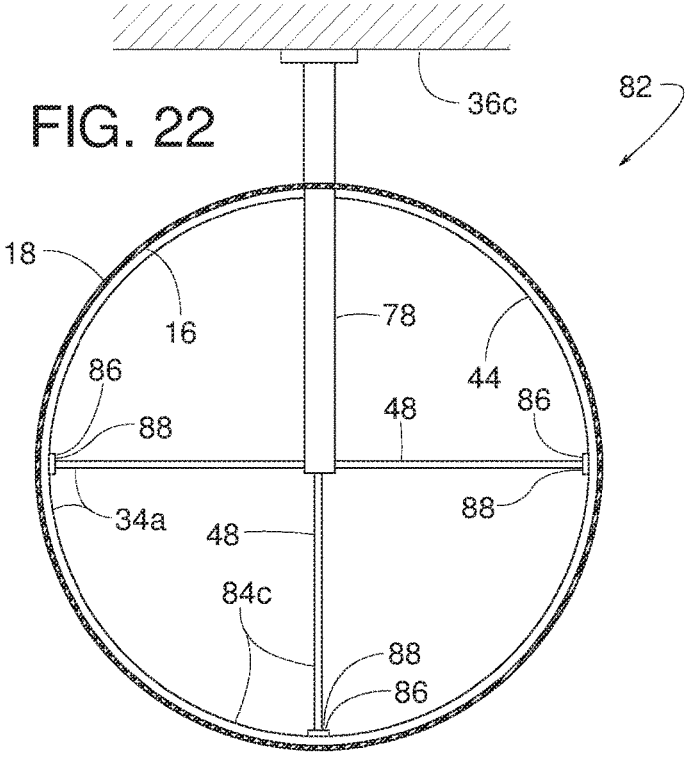
FIG. 22 is a cross-sectional view taken along line 22-22 of FIG. 17.

To help maintain an internal hoop's perpendicularity relative to the longitudinal direction 24, an example air duct assembly 82 includes a dual-hoop structure 84 (e.g., dual-hoop structures 84*a*, 84*b*, 84*c* and 84*d*), as shown in FIGS. 17-22. The dual-hoop structure 84, in some examples, comprises a framework 86 connecting a first hoop 34*a* to a second hoop 34*b*. Similar to hoop 34 of FIGS. 1-4, each hoop 34*a* and 34*b* includes the outer rim 44 supporting the sidewall 18. The framework 86 is schematically illustrated to represent an infinite variety of structures for connecting the hoops 34*a* to 34*b*. Some examples of the framework 86 are shown in FIGS. 18-21. FIG. 18 shows an example framework 86*a* comprising four struts 88 aligned with four corresponding spokes 48 of each hoop 34*a* and 34*b*. In this example, the struts 88 are substantially perpendicular to the spokes 48. In other examples, the struts 88 may be non-parallel to the spokes 48. In such examples, one or more of the struts 88 may cross each other. FIG. 19 shows a framework 86*b* comprising four struts 88 circumferentially offset relative to four spokes 48 of each hoop 34*a* and 34*b*. FIG. 20 shows a framework 86*c* comprising three struts 88 extending between the hoop 34*a* and 34*b*. FIG. 21 shows a framework 86*d* with a plurality of spokes 48 and a single strut 88 extending between central areas or hubs of the hoops 34*a* 34*b*. Examples of the framework 86 include any number of the spokes 48 (including zero), any number of the struts 88 (e.g., 2, 3, 4, etc.), and any suitable strut arrangement with any suitable angular orientation of the struts. Example cross-sectional shapes of the struts 88 include, but are not limited to, round, square, rectangular, tubular and solid.

The dual-hoop structures 84 may be positioned within the duct 16, coupled to the duct, and/or coupled to any other structures in any suitable manner. For example, the dual-hoop structure 84 can be disposed within the duct 16 without being directly connected to any hanger, as shown in the center dual-hoop structure 84*b* of FIG. 17. In some examples, the dual-hoop structure 84 is connected to one or more hangers similar to the hangers shown in FIGS. 1-10. In some examples, the dual-hoop structure 84 is connected to one or more brackets similar to those described with reference to FIGS. 13-16. For instance, the dual-hoop structure 84*c* shown in the far right of FIG. 17 is supported by the bracket 78, and the dual-hoop structure 84*a* shown in the far left of FIG. 17 is supported by a vertical bracket 78'.

To hold the duct 16 taut, in some examples, the bracket 78 urges the dual-hoop structure 84*c* away from the blower 12 to hold the sidewall 18 in tension between the blower flange 32 and the end cap 30. In some examples, the loops 40 (e.g., FIG. 3) fasten the dual-hoop structure 84*a* to the sidewall 18, and the brackets 78 and 78' urge the dual-hoop structures 84*a* and 84*c* apart to hold the sidewall 18 in tension between the dual-hoop structure 84*a* and the end cap 30.

In some examples, a series of dual-hoop structures 84 are distributed in a spaced-apart arrangement along the length of the duct 16 and are attached to the overhead support 36 (e.g., cable, track, ceiling, etc.) such that the means for attachment (e.g., brackets 78, hanger 38, hanger 70, etc.) in combination with the series of the dual-hoop structures 84 subject the sidewall 18 to tension between the dual-hoop structures 84. This is similar to what is shown in FIGS. 1-16, but with the use of the dual-hoop structures 84 instead of individual hoops 34. In addition, in some examples, the separate single hoops 34 or separate dual-hoop structures 84*b* are installed between the dual-hoop structures 84*a* and 84*c*, wherein such separate hoops 34 or dual-hoops 84*b* provide the sidewall 18 with radial support but virtually no longitudinal tension. In this example, the dual-hoop structures 84 are not being directly coupled to one another and/or are independently movable relative to one another. As set forth herein, not being directly coupled means that there is no shaft or other rigid object that connects the dual-hoop structures 84. While any spacing may be used (e.g., 0.5 ft., 1 ft., 1.5 ft., etc.), some examples of the dual-hoop structure 84 have their hoops 34*a* and 34*b* spaced apart about 2.5 ft. While any spacing for the dual-hoop structures 84 may be used (e.g., 5 ft., 7 ft., 18 ft., etc.), in some examples, the dual-hoop structures 84 that are attached to the hangers and the sidewall 18 are distributed in about forty-foot increments along the length of the duct 16 and subject the sidewall 18 to tension. Between those hanger-attached dual-hoop structures 84, in some examples, intermediate dual-hoop structures 84 or hoops 34 are distributed in about five-foot increments. In some examples, such intermediate dual-hoop structures 84 or hoops 34 are isolated from hangers and overhead support and, thus, apply virtually no longitudinal tension to sidewall 18.

Figure 23:
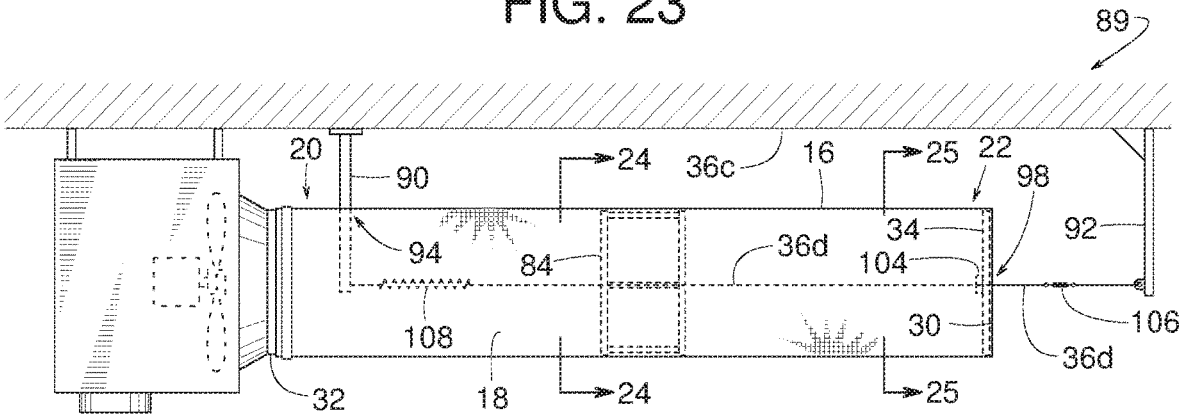
FIG. 23 is a side view of another example air duct assembly constructed in accordance with the teachings disclosed herein.
Figure 24:
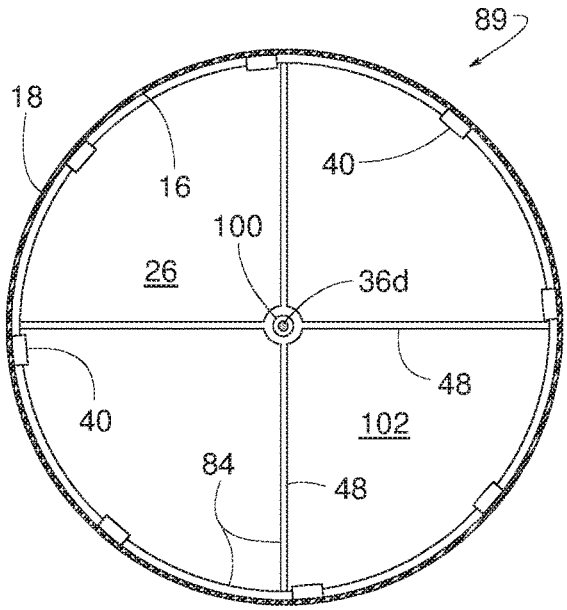
FIG. 24 is a cross-sectional view taken along line 24-24 of FIG. 23.
Figure 25:
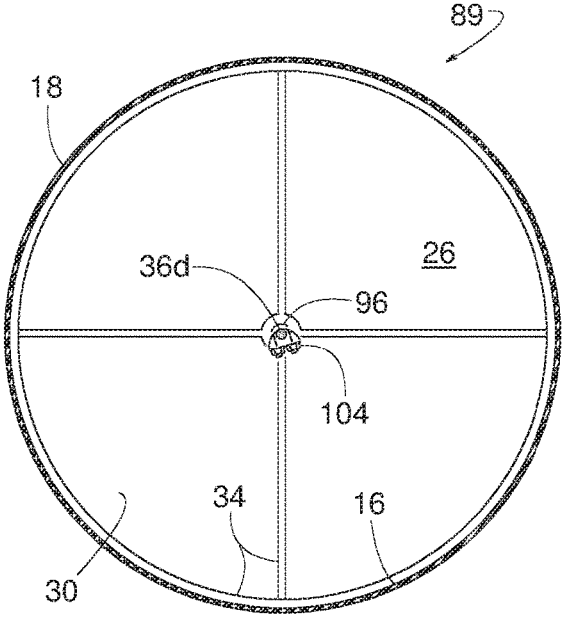
FIG. 25 is a cross-sectional view taken along line 25-25 of FIG. 23.

Referring to FIGS. 23-25, in some examples, an air duct assembly 89 includes the air duct 16 supported by an internal cable 36*d* (which is another example of an overhead support member). The cable 36*d* passes through the duct's interior 26 to provide the assembly 89 with a neat, clean appearance.

In the illustrated example, the cable 36*d* is held taut between the brackets 90 and 92, wherein the bracket 90 extends through an opening 94 in the sidewall 18. In some examples, as shown in FIG. 23, the cable 36*d* extends from the bracket 90, passes through the dual-hoop 84, passes through a central opening 96 in the hoop 34, passes through an opening 98 in the end cap 30, and attaches to the bracket 92. In some examples, the cable 36*d* passes through a central opening 100 in the dual-hoop 84, as shown in FIG. 24. In other examples, the cable 36*d* simply passes through the dual-hoop 84 via an open space 102 between the spokes 48. To hold the sidewall 18 taut between the bracket 92 and the blower flange 32, a cable clamp 104 on the cable 36*d* engages the hoop 34 so that tension in the cable 36*d* urges the hoop 34 and the end cap 30 away from the blower flange 32.

Figure 26:
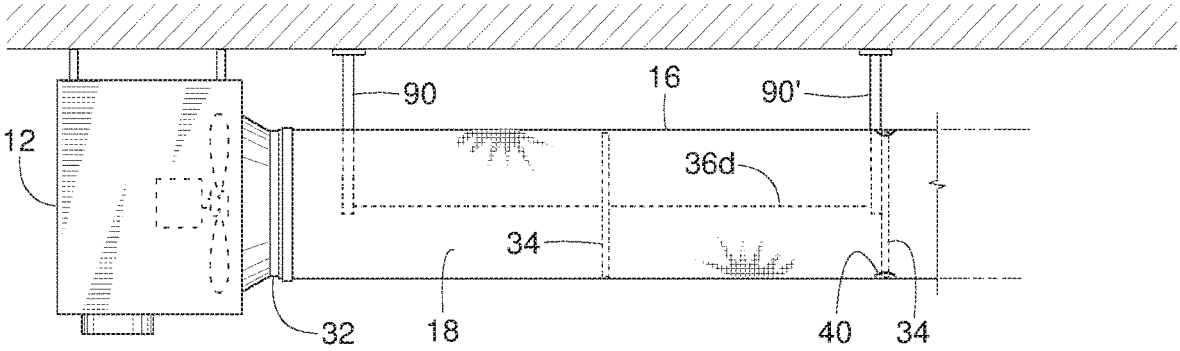
FIG. 26 is a side view of another example air duct assembly constructed in accordance with the teachings disclosed herein.

Referring to FIG. 26, in some examples, two brackets 90 and 90' extend through openings in the sidewall 18. In this example, the bracket 90' is attached to the hoop 34, and loops 40 (e.g., loop 40 of FIG. 3) connect the hoop 34 to the sidewall 18. The bracket 90' urges the hoop 34 away from the blower 12 to pull the sidewall 18 taut between the hoop 34 and the blower flange 32 and to pull the cable 36*d* taut between the brackets 90 and 90'. In some examples, to provide the duct 16 with additional radial support, an intermediate hoop 34 is installed between the brackets 90 and 90'. In some examples, the hoop 34 is attached to the sidewall 18 (e.g., attached via the loops 40, as shown in FIG. 3) and is attached to the cable 36*d* (e.g., attached via the clamp 104 as shown in FIGS. 23 and 25) such that the intermediate hoop 34 transfers tension in the cable 36*d* to the sidewall 18. In some examples, a similar method of attachment is applied to the intermediate dual-hoop structure 84 of FIG. 23.

In the examples of FIGS. 1-10 and 23-25, various means can be used for maintaining tension in the cable 36*a* and 36*d*. Examples of such tension maintaining means include, but are not limited to, a turnbuckle 106, a spring 108, elastic, biasing elements, and any combination thereof.

Figure 27:
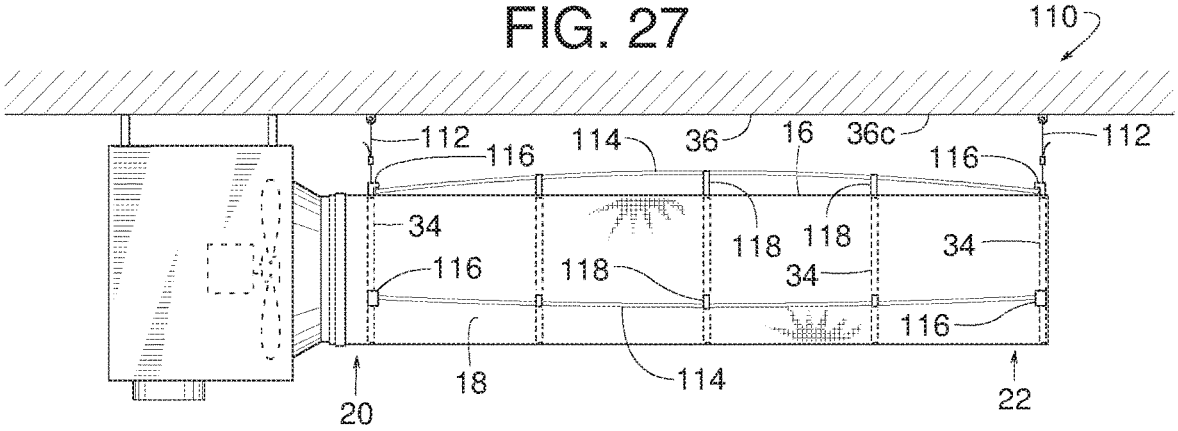
FIG. 27 is a side view of another example air duct assembly constructed in accordance with the teachings disclosed herein.

In the example shown in FIG. 27, an air duct assembly 110 comprises the air duct 16 with a plurality of the hoops 34. The loops 40 (e.g., loop 40 of FIG. 3) connect the hoops 34 to the sidewall 18. The hangers 112, of any suitable type, suspend the duct 16 from the overhead support member 36. To maintain the duct 16 in a generally expanded shape when deflated, a plurality of curved struts (e.g., struts in tension, straight poles bent and put in tension) 114 are resiliently bowed due to being longitudinally compressed between the lugs 116 extending from the hoops 34. The struts 114 being in compression places the sidewall 18 in tension between the hoops 34 that have the lugs 116 engaging opposite ends of the strut 114. Example materials of the struts 114 include, but are not limited to, fiberglass, aluminum and steel. Example cross-sectional shapes of the struts 114 include, but are not limited to, round, square, rectangular, tubular and solid. In some examples, the plurality of curved struts 114 are evenly distributed circumferentially around the duct 16. In other examples, the struts 114 are positioned within the duct 16. In some examples, the retainers 118 (e.g., straps, cable, chain, rope, clips, hooks, etc.) help hold the struts 114 in position relative to the duct 16.

Figure 40:
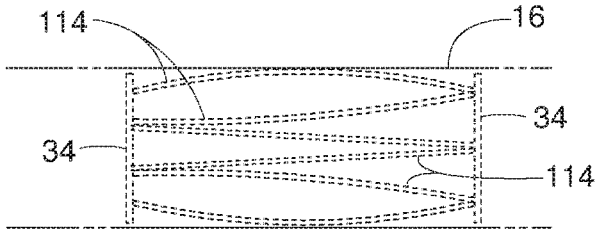
FIG. 40 is a side view similar to FIG. 38 but showing another example air duct assembly constructed in accordance with the teachings disclosed herein.

In the illustrated example, the struts 114 are not helically coiled. In other examples, however, each strut 114 is partially "coiled" less than 360 degrees (e.g., 10 to 20 degrees) around the circumferential interior of the duct 16. Such partial "coiling" allows the full length of each strut 114 to lay against the sidewall 18 while still being sufficiently bowed for transmitting longitudinal tension to the duct 16. In some examples, an even number of partially "coiled" struts 114 (e.g., four, six, eight, ten struts, etc.) are slightly "coiled" in opposite clockwise/counterclockwise directions to negate duct-twisting forces of the struts 114 (e.g., see FIG. 40).

Figure 28:
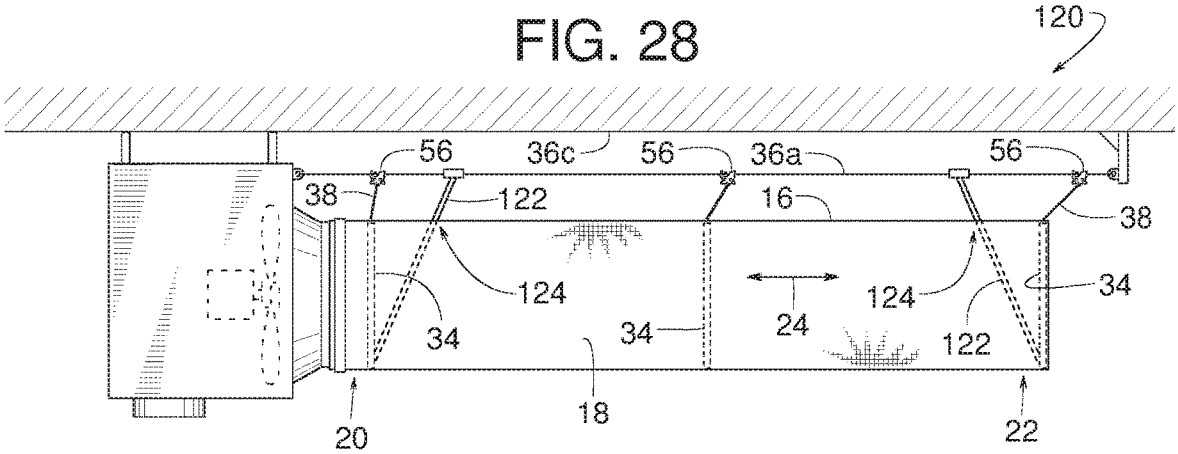
FIG. 28 is a side view of another example air duct assembly constructed in accordance with the teachings disclosed herein.

An example air duct assembly 120, shown in FIG. 28, is similar to the air duct assembly shown in FIG. 5 in that the hangers 38 are used for pulling the sidewall 18 taut. The air duct assembly 120, however, also includes one or more braces or brackets 122 that extend from the overhead support and/or the cable 36*a*, pass through an opening 124 in the sidewall 18, and attach to the hoops 34. The brackets 122 of the illustrated example help hold the hoops 34 substantially perpendicular relative to the longitudinal direction 24.

Figure 29:
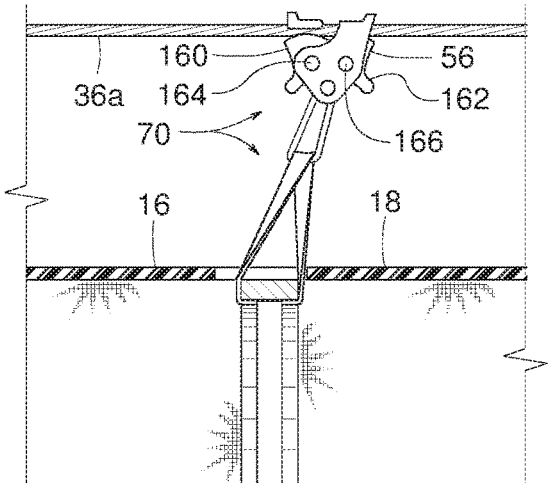
FIG. 29 is a cross-sectional view similar to FIG. 3.
Figure 30:
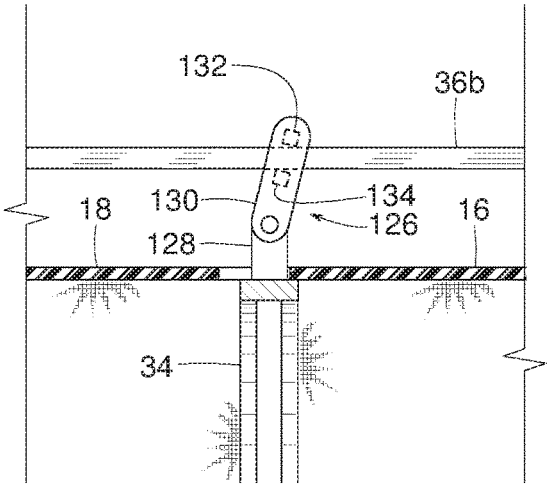
FIG. 30 is a cross-sectional view similar to FIG. 29 but showing an alternate example hanger constructed in accordance with the teachings disclosed herein.

FIGS. 29 and 30 show example hangers that can be used in the air duct assemblies 120, 14 and 68 for pulling the sidewall 18 taut. The hanger 70 of FIG. 29 is the same as the hanger 70 of FIG. 8, and the hanger 126 of FIG. 30 is a mechanism that works particularly well for gripping a track 36*b* that serves as the overhead support member. The hanger 126, in some examples, comprises a lug 128 attached to the hoop 34 and a pivotal link 130 pinned to the lug 128. The hoop 34 can be a single hoop or part of a dual-hoop structure (e.g., dual-hoop structure 84). The link 130 includes an upper projection 132 extending out over the top of the track 36*b* and a lower projection 134 beneath the track 36*b*. When the link 130 is vertical and relaxed with the projection 132 directly over the projection 134, the vertical spacing between the projections 132 and 134 provides sufficient clearance for the link 130 and the hanger 126 to slide freely along the track 36*b*. When longitudinal tension in the sidewall 18 tilts the link 130 (e.g., the longitudinal axis of the link 130 is non-parallel and non-perpendicular to the longitudinal axis of the duct 16), as shown in FIG. 30, the projections 132 and 134 bind tightly against upper and lower surfaces of the track 36*b*. As set forth herein, non-parallel means the objects are not parallel to one another (e.g., perpendicular). As set forth herein, non-perpendicular means the objects are not perpendicular to one another (e.g., parallel). Gripping friction of the binding action holds the hanger 126 fixed to the track 36*b*, thereby providing an alternative to the cable clamp 56.

During installation of the air duct 16, the installer can manually pull the hanger 126 to the right (as viewed in FIG. 30) along the track 36*b* to achieve a desired tension in the sidewall 18. Once achieving the desired tension, the installer releases the hanger 126, and the hanger 126 naturally tilts and holds itself in position, as shown in FIG. 30.

In the example of FIG. 29, the installation of the air duct 16 is slightly different. The illustrated example of the cable clamp 56 has two lever-actuated cam locks 160 and 162 that can pivot about the pins 164 and 166, respectively. Depending on the direction the cable clamp 56 is slid along the cable 36*a*, sliding friction between the cable 36*a* and the cable clamp 56 urges one cam lock 160 or 162 to pivot so as to grip the cable 36*a* and urges the other cam lock 160 or 162 to pivot so as to release the cable 36*a*. In some examples, the cam locks 160 and 162 are spring biased to their gripping position against the cable 36*a*.

When the cable clamp 56 has two opposing cam locks, as shown in FIG. 29, one cam lock 160 or 162 will grip the cable 36*a*, regardless of which direction the cable clamp 56 is urged to move along the cable 36*a*. However, manually rotating the gripping cam lock 160 or 162 away from the cable 36*a* releases its grip, which allows an installer to freely slide the cable clamp 56 along the cable 36*a* to achieve a desired tension in the sidewall 18. Once achieving the desired tension, the installer releases the cable clamp 56 and/or the hanger 70, which returns the gripping cam lock 160 or 162 to its gripping engagement with the cable 36*a* to hold the cable clamp 56 in position and thus maintain the tension in the sidewall 18. In the example illustrated in FIG. 29, the cam lock 160 is the one used for gripping the cable 36*a*.

In some examples, the cam lock 162 is omitted to create a unidirectional cable clamp 168. The unidirectional cable clamp 168 can be used in place of the cable clamp 56 of FIG. 29 or used in the example shown in FIG. 31. Unidirectional clamping allows an installer to freely slide the cable clamp 168 in its non-gripping direction 170 (as opposed to its gripping direction 172) along the cable 36*a* to achieve a desired tension in the sidewall 18. Once achieving the desired tension, the installer simply releases the cable clamp 168 and/or its respective hanger 176, and the cam lock 160 automatically grips the cable 36*a* to hold the cable clamp 168 in position and thus maintain the tension in the sidewall 18.

Figure 31:
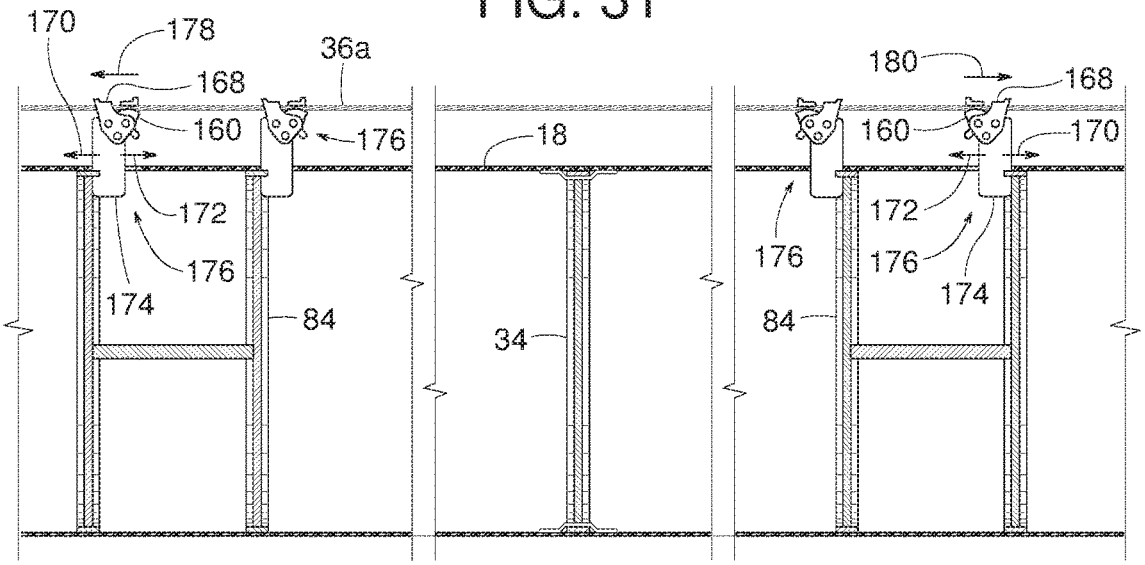
FIG. 31 is a cross-sectional view of another example air duct assembly constructed in accordance with the teachings disclosed herein.

Unidirectional cable clamp 168 can be used in a wide variety of air duct assemblies including, but not limited to, the examples shown in FIGS. 1-12, 23-26, 28, 29, and 31-39. In the example of FIG. 31, the cable clamp 168 is part of the hanger 176, which includes a rigid member 174 (e.g., a metal plate) connected to the dual-hoop structure 84. The clamping direction of the clamps 168 of the illustrated example point away from each other in opposite longitudinal directions 178 and 180. In this example, one of the hangers 174 is coupled to each of the dual-hoop structures 84 to substantially prevent the dual-hoop structure 84 from rotating relative to a longitudinal axis of the duct 16. This allows clamped dual-hoops 84 (alternatively clamped single hoops 34) to be manually forced away from each other to achieve a desired tension in the sidewall 18 between the clamped dual-hoops 84. In some examples, one or more intermediate hoops 34 or dual-hoops 84 attached only to the sidewall 18 are installed between the two the dual-hoops 84 that are clamped to the cable 36*a*.

Figure 32:
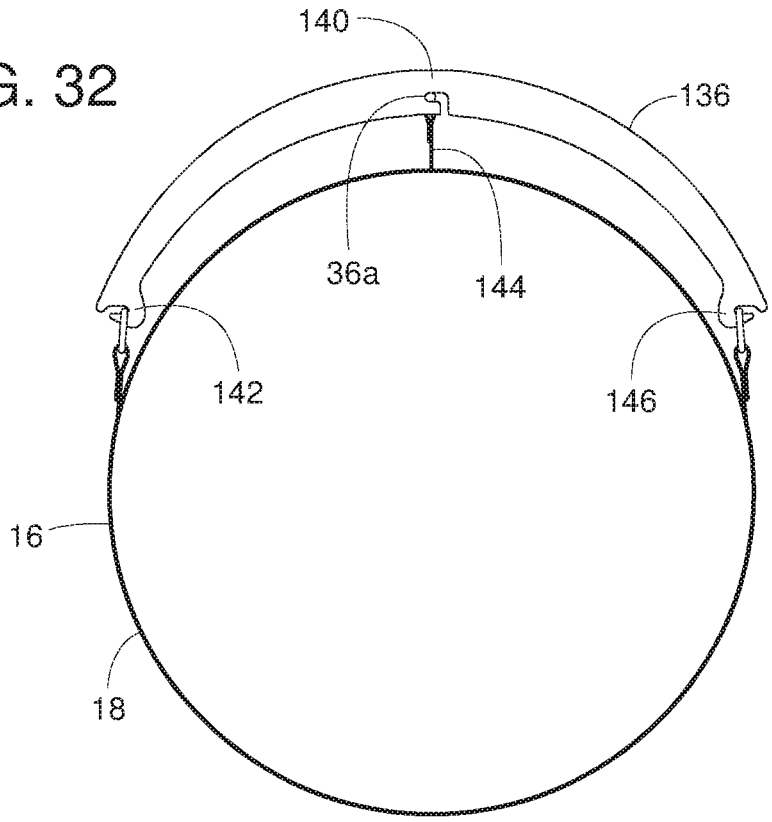
FIG. 32 is a cross-sectional view similar to FIG. 5 but showing an alternate hanger system constructed in accordance with the teachings disclosed herein.
Figure 33:
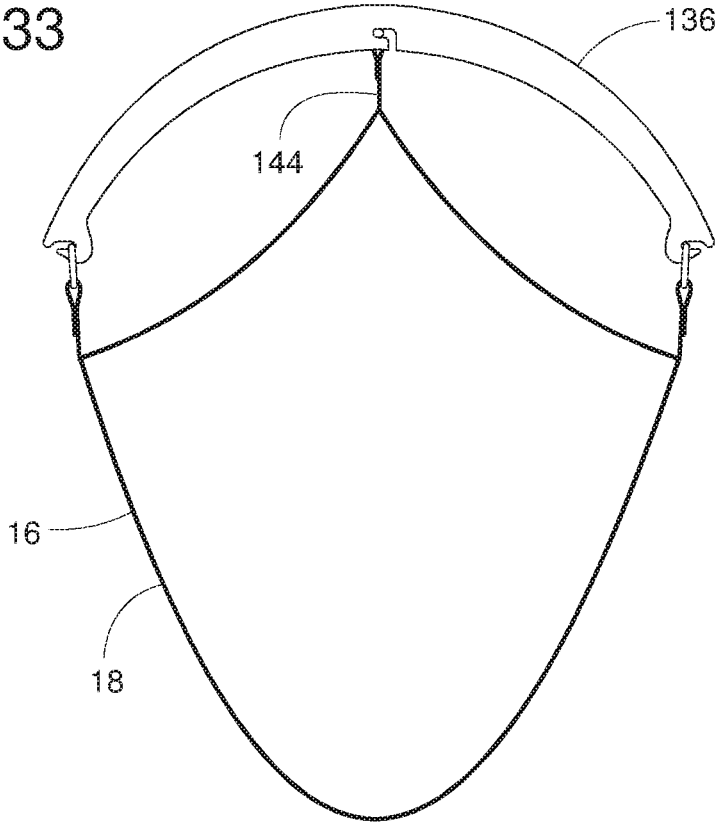
FIG. 33 is a cross-sectional view similar to FIG. 32 but showing the duct deflated.
Figure 34:
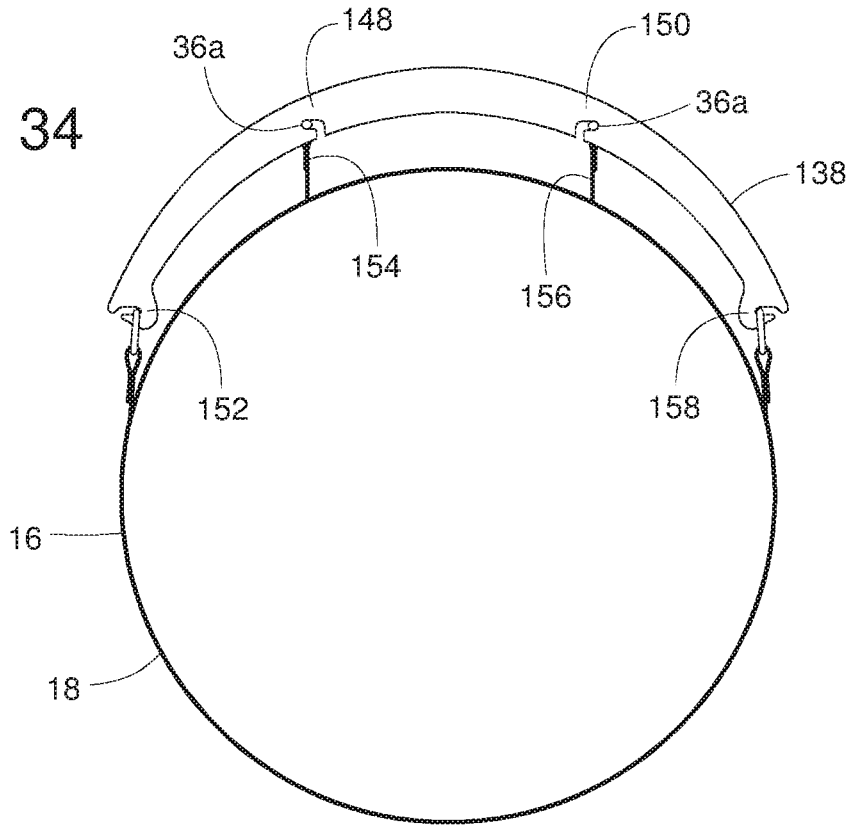
FIG. 34 is a cross-sectional view similar to FIG. 33 but showing an alternate hanger system constructed in accordance with the teachings disclosed herein.
Figure 35:
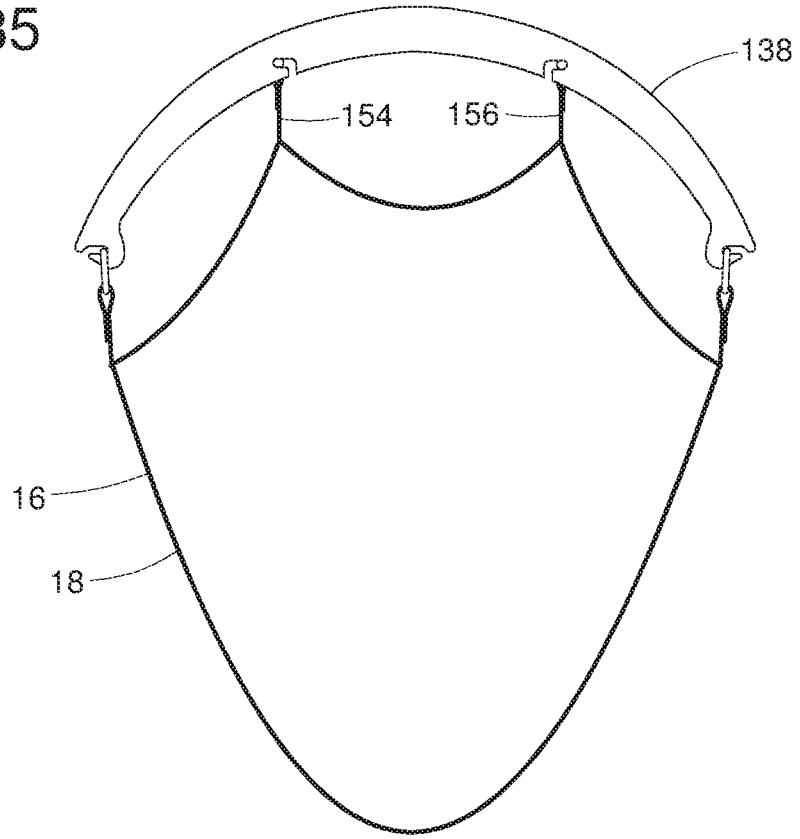
FIG. 35 is a cross-sectional view similar to FIG. 34 but showing the duct deflated.

As mentioned earlier, FIGS. 32-35 show some example hanger systems that can be incorporated in many of the example air duct assemblies disclosed herein. FIG. 32 shows an example curved frame 136 that has one upper point 140 connected to the cable 36*a* (or some other overhead support) and two lower points 142 and 146 connected to the duct 16. In some examples, a separate hanger 144 (e.g., strap, cable, etc.) connects the sidewall 18 to cable 36*a*. FIG. 32 shows the frame 136 with the duct 16 inflated, and FIG. 33 shows the frame 136 with duct 16 deflated. FIG. 34 shows an example curved frame 138 plus two separate hangers 154 and 156. The frame 138 that has two upper points 148 and 150 connected to a set of two cables 36*a* (or some other overhead support) and two lower points 152 and 158 connected to the duct 16. FIG. 34 shows the frame 138 with the duct 16 inflated, and FIG. 35 shows the frame 138 with the duct 16 deflated.

Figure 36:
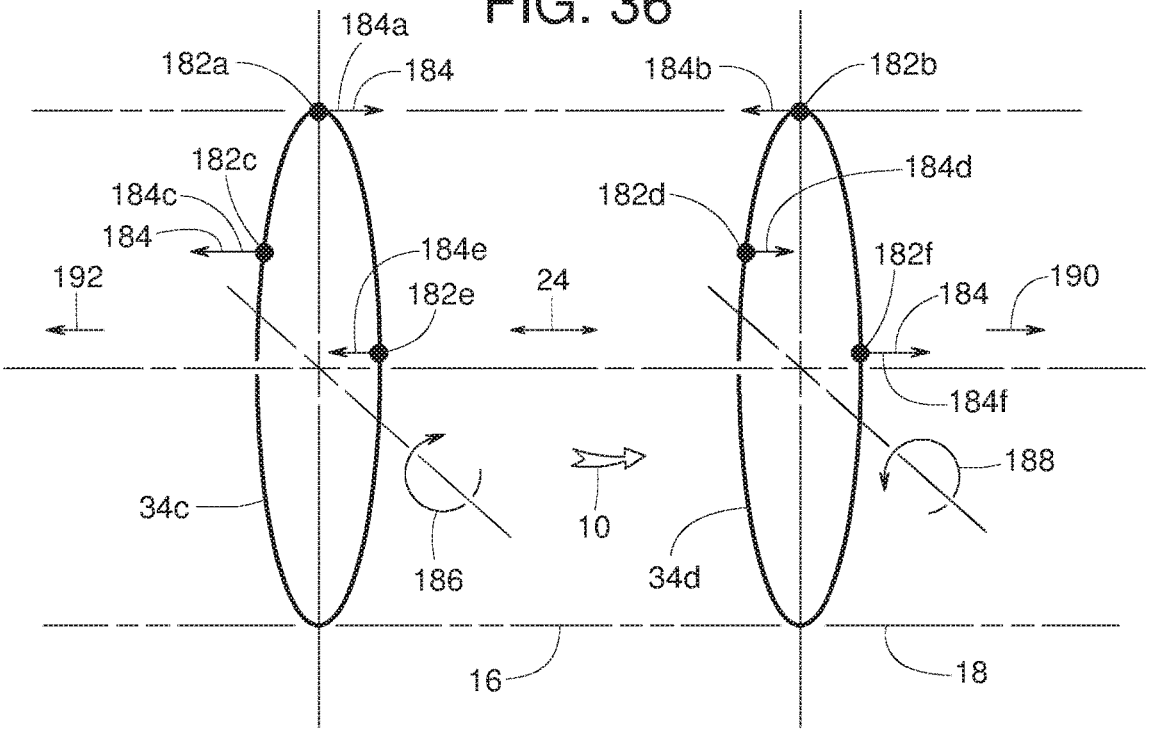
FIG. 36 is a schematic diagram of example tension and torque configurations applicable to various air duct assemblies constructed in accordance with the teachings disclosed herein.

Referring to FIG. 36 with reference to FIGS. 4 and 5, some examples of the duct 16 are supported by a plurality of hangers 38 (alternatively non-tilted rigid hangers) that are distributed circumferentially, for example, at the 12:00 position (FIG. 5) plus at the 2:30 and 9:30 positions (FIG. 4). An example of such an arrangement is shown in FIG. 36. When a single hoop 34 or a dual-hoop structure 84 is supported by multiple hangers (e.g., the arrangement of FIG. 4, the arrangement of FIG. 36, and an arrangement comprising a combination of FIGS. 4 and 5), the hangers can exert forces that not only hold the duct 16 taut but also help hold hoop 34 generally perpendicular relative to the longitudinal direction 24. The hoop 34 being substantially perpendicular relative to the longitudinal direction 24 means that the hoop 34 lies along and, thus, defines an imaginary plane which is substantially perpendicular to the longitudinal direction 24.

In the example schematically illustrated in FIG. 36, a plurality of hangers 182 (e.g., hangers 182*a*, 182*b*, 182*c*, 182*d*, 182*e* and 182*f*) connect to a plurality of hoops 34 (e.g., hoops 34*c* and 34*d*). The hangers 182 are schematically illustrated to represent any rigid, flexible, elongate or non-elongate hanger for supporting duct 16. Examples of the hanger 182 include, but are not limited to, all of the example hangers disclosed herein such as, for examples, the hangers shown in FIGS. 1-17, 22, 23, 27-35.

In examples where the hangers 182 exert a pulling force along a tilted direction (neither parallel nor perpendicular to the longitudinal direction 24), such a pulling force may have a longitudinal component of force that transfers to the hoop 34 (transferred directly or via sidewall 18) to help hold the duct 16 taut and/or to help hold the hoop 34 substantially perpendicular to the longitudinal direction 24. In examples where the pulling force is purely in the longitudinal direction 24, the longitudinal component comprises the entire pulling force.

In the example illustrated in FIG. 36, the hangers 182*a-f* provide longitudinal component of the forces 184*a-f* respectively. In this example, the forces 184*c-f* subject the duct 16 to longitudinal tension. Force 184*a* in combination with forces 184*c* and 184*e* subjects hoop 34*c* to a rotational moment 186 that helps maintain the hoop 34*c* substantially perpendicular relative to the longitudinal direction 24. Likewise, the force 184*b* in combination with forces 184*d* and 184*f* subjects the hoop 34*d* to a rotational moment 188 that helps maintain the hoop 34*d* substantially perpendicular relative to the longitudinal direction 24.

In some examples, there is a difference in the magnitude and/or direction of the forces 184*a-f* to achieve the desired combination of duct tension and hoop substantial perpendicularity. Examples of such differences include, but are not limited to, the forces 184*c-f* having a greater magnitude than the forces 184*a-b*, the forces 184*a-b* having a greater magnitude than the forces 184*c-f*, the force 184*a* pointing in a downstream direction 190 while the forces 184*c* and 184*e* point in an upstream direction 192, and the force 184*b* pointing in upstream direction 192 while the forces 184*d* and 184*f* point in the downstream direction 190. The upstream direction 192 and the downstream direction 190 point in opposite directions but both lay parallel the longitudinal direction 24. The term, "upstream direction" and "downstream direction" are with reference to the primary flow direction of the air 10.

In some examples, the forces 184*a*, 184*c* and 184*e* all point in the same direction (for desired tension) but have a different magnitude (to hold the hoop 34*c* substantially perpendicular relative to the longitudinal direction 24). In some examples, the forces 184*b*, 184*d* and 184*f* all point in the same direction (for desired tension) but have a different magnitude (to hold the hoop 34*d* substantially perpendicular relative to the longitudinal direction 24). In some examples, each of the forces 184*a-f* point in the same direction. In some examples, the forces 184*a*, 184*c* and 184*e* each point in the upstream direction 192 while each of the forces 184*b*, 184*d* and 184*f* point in the downstream direction 190.

Figure 37:
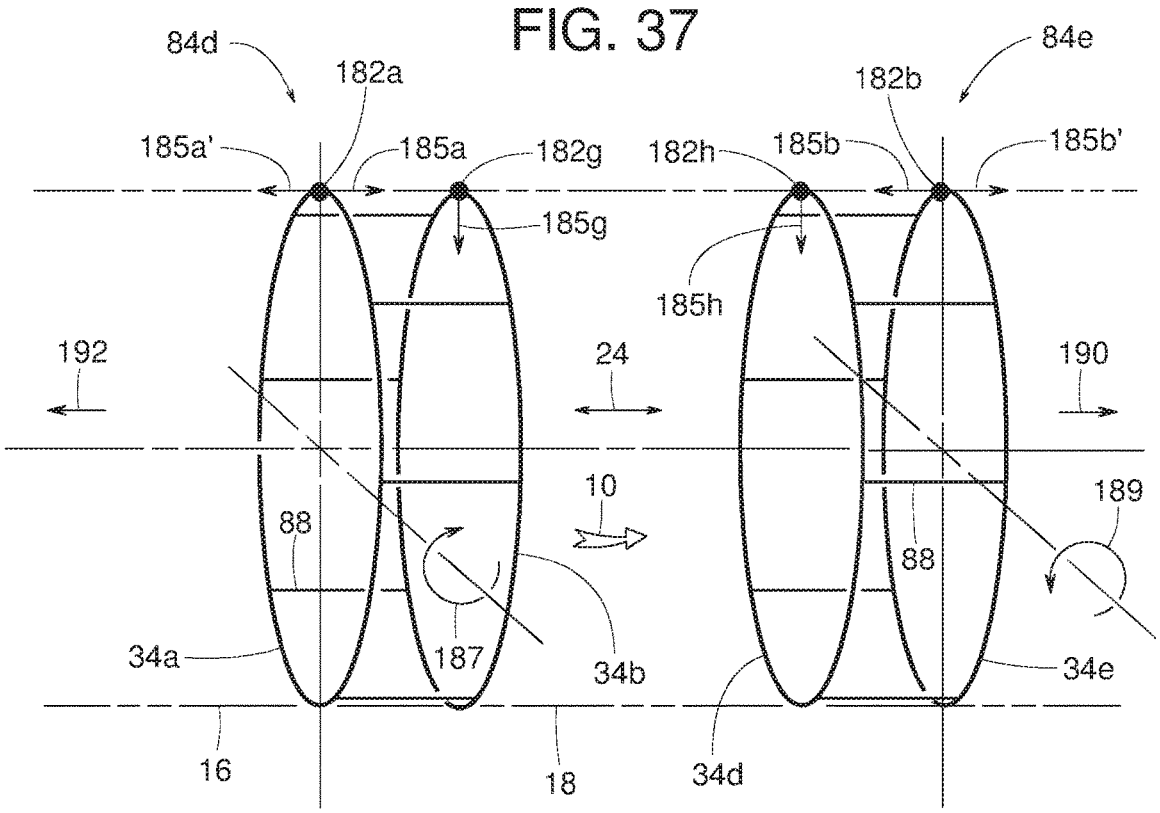
FIG. 37 is a schematic diagram of other example tension and torque configurations applicable to various air duct assemblies constructed in accordance with the teachings disclosed herein.
Figure 38:
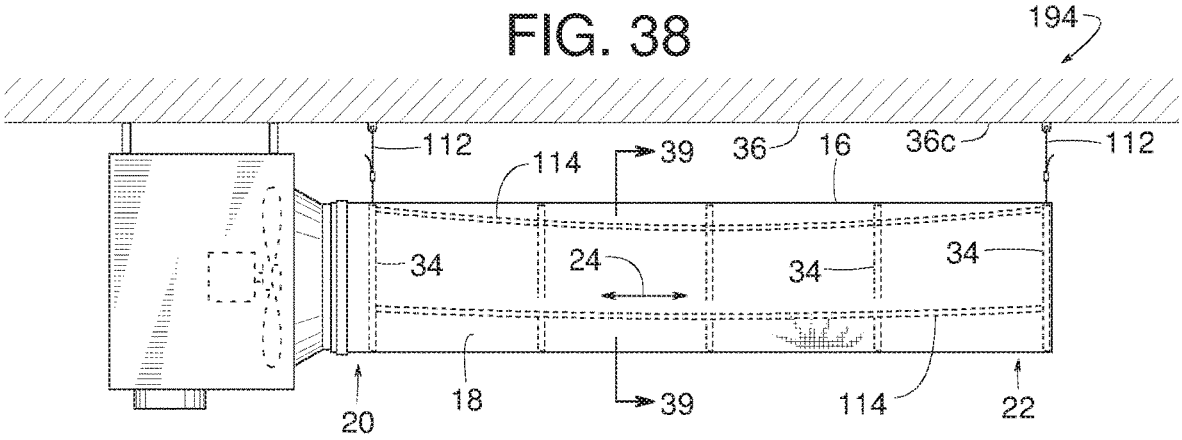
FIG. 38 is a side view of another example air duct assembly constructed in accordance with the teachings disclosed herein.

The example illustrated in FIG. 37, comprises at least two dual-hoop structures 84 (e.g., a dual-hoop structures 84*d* and 84*e*). The dual-hoop structure 84*d* comprises the hoops 34*a* and 34*b* interconnected by one or more struts 88. Likewise, the dual-hoop structure 84*e* comprises the hoops 34*d* and 34*e* interconnected by similar one or more struts 88. The hanger 182*a* supports the dual-hoop structure 84*d*, and the hanger 182*b* supports the dual-hoop structure 84*e*.

The hangers 182*a* and 182*b* provide longitudinal component of forces 185*a* and 185*b*, respectively. The forces 182*a-b* subject the duct 16 to longitudinal tension. A downward force 185*g* (via hoop weight and/or a hanger 182*g*) in combination with the force 185*a* subject the hoop 34*a* to a rotational moment 187 that helps maintain the hoop 34*a* substantially perpendicular relative to the longitudinal direction 24. Likewise, a downward force 185*h* (via hoop weight and/or a hanger 182*h*) in combination with the force 185*b* subject the hoop 34*e* to a rotational moment 189 that helps maintain the hoop 34*e* substantially perpendicular relative to the longitudinal direction 24.

In some examples, there is a difference in the magnitude and/or direction of the forces 185*a*, 185*b*, 185*g* and 185*h* to achieve the desired combination of duct tension and hoop perpendicularity. Examples of such differences include, but are not limited to, the forces 185*g-h* having a greater magnitude than the forces 185*a-b*, the forces 185*a-b* having a greater magnitude than the forces 185*g-h*, a force 185*a*' pointing in the upstream direction 192 while the force 185*g* points vertically downward, and a force 185*b*' pointing in the downstream direction 190 while the force 185*h* points vertically downward. The upstream direction 192 and the downstream direction 190 point in opposite directions but both lay parallel to the longitudinal direction 24. The terms, "upstream direction" and "downstream direction" are with reference to the primary flow direction of the air 10.

Figure 39:
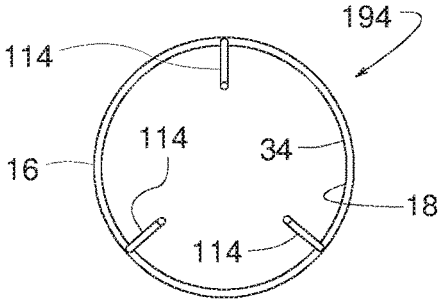
FIG. 39 is a cross-sectional view taken along line 39-39 of FIG. 38.

FIG. 39 shows an example air duct assembly 194 that is similar to the air duct assembly 110 of FIG. 27; however, with the air duct assembly 194, the curved struts 114 are installed within the interior of the duct 16. The struts 114 are resiliently bowed due to being longitudinally compressed between the hoops 34. The struts 114 being in compression places the sidewall 18 in tension between the hoops 34 that engage opposite ends of each strut 114.

In the illustrated example, the struts 114 are not helically coiled. In other examples, however, each strut 114 is partially "coiled" less than 360 degrees (e.g., between about 10 and 20 degrees) around the circumferential interior of the duct 16 (e.g., see FIG. 40). Such partial "coiling" allows the full length of each strut 114 to lay against the sidewall 18 while still being sufficiently bowed for transmitting longitudinal tension to the duct 16. In some examples, an even number of partially "coiled" struts 114 (e.g., four, six, eight struts, etc.) are "coiled" in opposite clockwise/counterclockwise directions to negate duct-twisting forces of the struts 114.

In some examples, the air duct assembly 194 includes some means for assisting in holding the struts 114 in position. Examples of such means include, but are not limited to, a strut-engaging retaining ring at the hoop 34, a strut-engaging recesses in the hoop 34, straps, cables, chains, ropes, clips, hooks, and various combinations thereof.

It should be noted that any of the individual features (e.g., hangers, hoops, rims, spokes, loops, overhead support members, sidewalls, air ducts, brackets, cable clamps, frame-works, etc.) disclosed in one or more of FIGS. 1-35 can be readily incorporated in one or more other example air duct assemblies disclosed herein.

U.S. Pat. Nos. 6,280,320; 6,425,417; 8,434,526; US publication 2008/0113610 A2 and US publication 2012/0028562 A1 are incorporated herein by reference in their entireties.

As set forth herein, an example air duct assembly includes an air duct having an inflated state and a deflated state. The air duct includes a sidewall that is pliable. The sidewall defines an interior of the air duct and an external area outside the air duct. The air duct assembly also includes a first overhead support member in the external area outside the air duct and a second overhead support member in the external area outside the air duct. The first overhead support member and the second overhead support member defining a separation distance therebetween. The air duct assembly also includes a hoop disposed within the interior of the air duct. The hoop provides the sidewall with support in a radial direction that is substantially perpendicular to the longitudinal direction. The air duct assembly also includes a loop disposed within the interior of the air duct and fastening the hoop with respect to the sidewall and a first hanger coupling at least one of the sidewall, the loop, or the hoop to the first overhead support member. The first hanger transmits a first pulling force that subjects the sidewall to tension in the longitudinal direction when the air duct is in the deflated state. The air duct assembly also includes a second hanger coupling at least one of the sidewall, the loop, or the hoop to the second overhead support member. The second hanger transmits a second pulling force that subjects the sidewall to tension in the longitudinal direction when the air duct is in the deflated state. The first hanger and the second hanger are spaced apart from each other by virtue of the separation distance between the first overhead support member and the second overhead support member.

In some examples, at least one of the first hanger or the second hanger is elongate in a tilted direction that is angularly displaced out of collinear alignment with both the longitudinal direction and the radial direction, and at least one of the first pulling force or the second pulling force is along the tilted direction when the air duct is in the deflated state.

In some examples, the first pulling force and the second pulling force applied to the hoop create a rotational moment that maintains the hoop in a substantially perpendicular orientation relative to the longitudinal direction.

In some examples, the first hanger and the second hanger provide a first set of hangers and the air duct assembly also includes a second set of hangers where the second set of hangers being spaced apart from the first set of hangers with respect to the longitudinal direction, the first set of hangers and the second set of hangers pulling the sidewall in opposite directions parallel to the longitudinal direction. In some examples, the hanger includes the loop. In some examples, the hanger passes through an opening in the sidewall. In some examples, the first hanger includes a connector. The overhead support member is one of a cable and a track that is elongate in the longitudinal direction, and the connector is attached to one of the cable and the track so as to substantially prevent relative longitudinal movement between the connector and the overhead support member.

In some examples, the overhead support member includes a plurality of spaced apart cables that are elongate in the longitudinal direction. In some examples, the first hanger and the second hanger are spaced apart from each other by virtue of the separation distance between the cables. In some examples, the loop is one a plurality of loops circumferentially distributed around the hoop. In some examples, the air duct extends in the longitudinal direction from an upstream end to a downstream end of the air duct, and the hanger is at an intermediate position spaced apart from the upstream end and the downstream end.

An example air duct assembly for conveying air in a downstream direction, which is opposite an upstream direction, includes an air duct having an inflated state and a deflated state. The air duct is elongate in a longitudinal direction. The air duct includes a sidewall that is pliable. The sidewall to define an interior of the air duct and an external area outside the air duct. The air duct assembly includes first and second cables radially offset relative to the air duct. The air duct assembly includes a hoop providing the sidewall with support in a radial direction that is substantially perpendicular to the longitudinal direction. The air duct assembly includes a first hanger coupled to at least one of the hoop or the sidewall and the first cable where a first pulling force is transferred to the hoop or the sidewall from the first hanger. The air duct assembly includes a second hanger radially spaced apart from the first hanger and coupled to at least one of the hoop or the sidewall and the second cable where a second pulling force is transferred to the hoop or the side wall from the second hanger and where the first and second hangers is independently couplable and adjustable relative to the respective first and second cables or tracks.

In some examples, the first pulling force includes a first longitudinal component of force substantially parallel to the longitudinal direction and the second pulling force includes a second longitudinal component of force substantially parallel to the longitudinal direction where the first longitudinal component of force is distinguishable from the second longitudinal component of force by a characteristic that includes at least one of magnitude or direction. In some examples, the first longitudinal component of force is greater in magnitude than the second longitudinal component of force and a difference in magnitude between the first longitudinal component of force and the second longitudinal component of force subjects the hoop to a rotational moment that helps maintain a plane of the hoop substantially perpendicular to the longitudinal direction.

In some examples, the first longitudinal component of force points in the upstream direction and the second longitudinal component of force points in the downstream direction, and a difference in direction between the first longitudinal component of force and the second longitudinal component of force subjects the hoop to a rotational moment that helps maintain a plane of the hoop substantially perpendicular to the longitudinal direction.

An example air duct assembly includes an air duct having an inflated state and a deflated state. The air duct is elongate in a longitudinal direction and extending from an upstream end to a downstream end. The air duct includes a sidewall that is pliable. The sidewall being tubular to define an interior of the air duct and an external area outside the air duct. The air duct assembly includes a cable or track and first and second hangers suspending the air duct from the overhead support. The first and second hangers are spaced apart and distributed in the longitudinal direction between the upstream end and the downstream end. The first and second hangers are non-perpendicular and non-parallel relative to the longitudinal axis to apply tension to the sidewall in the longitudinal direction.

In some examples, the first and second hangers are angularly displaced out of collinear alignment with both the longitudinal direction and a radial direction where the radial direction is perpendicular relative to the longitudinal direction. In some examples, the first and second hangers urge the sidewall in opposite longitudinal directions. In some examples, the first hanger or the second hanger is at an intermediate position between and spaced apart from the upstream end and the downstream end.

In some examples, air duct assembly includes a first dual-hoop structure proximate a third hanger where the first dual-hoop structure includes first and second hoops disposed within the interior of the air duct and a second dual-hoop structure proximate the fourth hanger where the second dual-hoop structure comprising third and fourth hoops disposed within the interior of the air duct.

In some examples, the air duct assembly also includes a fifth hanger proximate the first dual-hoop structure and being spaced apart from the third hanger where the third hanger is coupled to the first hoop and the fourth hanger is coupled to the second hoop to provide a first rotational moment that maintains the first and second hoops substantially perpendicular relative to the longitudinal direction.

In some examples, the air duct assembly also includes a sixth hanger proximate the second dual-hoop structure and spaced apart from the fourth hanger where the fourth hanger is coupled to the third hoop and the sixth hanger is coupled to the fourth hoop to provide a second rotational moment that maintains the third and fourth hoops substantially perpendicular relative to the longitudinal direction. In some examples, the fifth hanger exerts a downward force against the first dual-hoop structure.

An example air duct assembly includes an air duct elongate in a longitudinal direction. The air duct includes a sidewall that is pliable, the sidewall being tubular and defining an interior of the air duct and an external area outside the air duct. The air duct assembly includes an overhead support member in the external area outside the air duct and a hoop disposed within the interior of the air duct. The hoop provides the sidewall with support in a radial direction that is substantially perpendicular to the longitudinal direction and a bracket passing through an opening in the sidewall and extending from the hoop to the overhead support member. The bracket is more rigid than the sidewall and the bracket cooperating with the hoop to subject the air duct to tension in the longitudinal direction. The bracket and the hoop are non-adjustably coupled.

In some examples, the hoop includes an outer rim, and the bracket connects to the outer rim. In some examples, the hoop includes a central region, and the bracket connects to the central region. In some examples, the hoop includes an outer rim, a central region and a spoke extending between the central region and the outer rim, and the bracket connects to the spoke.

An example air duct assembly includes an air duct elongate in a longitudinal direction. The air duct includes a sidewall that is pliable. The sidewall defines an interior of the air duct and an external area outside the air duct. The air duct assembly includes a cable or track a first dual-hoop structure to provide the sidewall with support in a radial direction that is substantially perpendicular relative to the longitudinal direction. The air duct assembly includes a bracket connecting the first dual-hoop structure to the cable or track where the bracket being more rigid than the sidewall.

In some examples, the first dual-hoop structure includes a first hoop having an outer rim, and the bracket connects to the outer rim. In some examples, the first dual-hoop structure includes a first hoop having a spoke and a central region, and the bracket connects to at least one of the spoke or the central region. In some examples, the bracket connects to the framework of the first dual-hoop structure. In some examples, the air duct assembly includes a second bracket where the bracket connects to a first hoop of the first dual-hoop structure, and the second bracket connects to a second hoop of the first dual-hoop structure.

In some examples, the air duct assembly includes a second dual-hoop structure where the first dual-hoop structure and the second dual-hoop structure being spaced apart from each other, the first dual-hoop structure not being directly coupled to and independently movable relative to the second dual-hoop structure. In some examples, the air duct assembly is free of any appreciable airflow obstruction within the interior of the air duct between the first dual-hoop structure and the second dual-hoop structure. In some examples, the bracket and the first dual-hoop structure are to subject the air duct to tension in the longitudinal direction.

An example air duct assembly includes an air duct comprising a sidewall that is pliable where the sidewall defines an interior of the air duct. The air duct assembly includes a first hoop disposed within the interior of the air duct where the first hoop provides the sidewall with support in a radial direction that is substantially perpendicular to the longitudinal direction. The air duct assembly includes a cable disposed within the interior of the air duct. The cable is elongate in the longitudinal direction. The cable engages the first hoop to help support the weight of the first hoop and the sidewall.

In some examples, the first hoop includes an outer rim, a central region, and a spoke extending between the central region and the outer rim, and the cable connects to the central region. In some examples, the air duct assembly also includes a second hoop disposed within the interior of the air duct where the second hoop provides the sidewall with support in the radial direction and the cable engages the second hoop. The cable is in tension between the first hoop and the second hoop subjects the sidewall to tension in the longitudinal direction. In some examples, the air duct assembly also includes a dual-hoop structure that includes the first hoop and a second hoop similar to the first hoop, and a framework holding the first hoop spaced apart from the second hoop.

An example air duct assembly includes an air duct comprising a sidewall that is pliable, the sidewall defining an interior of the air duct and an external area outside the air duct and a strut being elongate in the longitudinal direction. The curved strut having opposite ends proximate the upstream end and the downstream end of the air duct, the strut being in compression between the upstream end and the downstream end subjects the sidewall to tension in the longitudinal direction.

An example air duct assembly includes an air duct having a sidewall that is pliable. The sidewall defines an interior of the air duct and an external area outside the air duct. The air duct assembly includes a curved strut elongate in the longitudinal direction. The curved strut has opposite ends proximate the upstream end and the downstream end of the air duct.

The curved strut is in compression between the upstream end and the downstream end to subject the sidewall to tension in the longitudinal direction.

In some example examples, the air duct assembly includes an overhead support carrying weight of the air duct and the curved strut. In some example examples, the air duct assembly includes a hoop disposed within the interior of the air duct. The hoop provides the sidewall with support in a radial direction that is substantially perpendicular to the longitudinal direction. In some example examples, the air duct assembly includes a lug extending from the hoop to the external area outside the air duct, the curved strut engaging the lug. In some examples, the curved strut is in the external area outside the air duct. In some examples, the curved strut is within the interior of the air duct.

An example air duct assembly includes an air duct to have an inflated state and a deflated state. The air duct includes a sidewall that is pliable. The sidewall to define an interior of the air duct and an external area outside the air duct. The air duct assembly includes a first overhead support member to be in the external area outside the air duct and a second overhead support member to be in the external area outside the air duct. The first overhead support member and the second overhead support member to define a separation distance therebetween and a hoop to be disposed within the interior of the air duct, the hoop to provide the sidewall with support in a radial direction that is substantially perpendicular to the longitudinal direction. The air duct assembly includes a loop to be disposed within the interior of the air duct and to fastening the hoop with respect to the sidewall. The air ducat assembly includes a first hanger to couple at least one of the sidewall, the loop, or the hoop to the first overhead support member. The first hanger is to transmit a first pulling force that subjects the sidewall to tension in the longitudinal direction when the air duct is in the deflated state and a second hanger to couple at least one of the sidewall, the loop, or the hoop to the second overhead support member. The second hanger to transmit a second pulling force that subjects the sidewall to tension in the longitudinal direction when the air duct is in the deflated state. The first hanger and the second hanger are spaced apart from each other by virtue of the separation distance between the first overhead support member and the second overhead support member.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. An air duct assembly comprising:

an air duct elongate in a longitudinal direction, the air duct including a tubular sidewall that is pliable; and a strut having a first end and a second end, the first end of the strut to be coupled an upstream end of the air duct and the second end to be coupled to a downstream end of the air duct, the strut having a curved shape and being compressed when coupled to the air duct to place the sidewall in tension along a longitudinal length of the air duct.

2. The air duct assembly of claim 1, further including a first hoop coupled to the air duct and a second hoop coupled to the air duct.

3. The air duct assembly of claim 2, wherein the strut is to be bowed while causing the sidewall to be in tension between the first hoop and the second hoop.

4. The air duct assembly of claim 2, wherein the strut is to be connected to the first hoop and the second hoop via a plurality of lugs.

5. The air duct assembly of claim 1, wherein the strut is to be external to the sidewall of the air duct.

6. The air duct assembly of claim 1, further including a retainer to hold the strut in position relative to the air duct, the retainer extending between the air duct and the strut.

7. The air duct assembly of claim 1, wherein the strut is to be installed in an interior of the air duct.

8. The air duct assembly of claim 1, wherein the strut is helically coiled to abut the sidewall of the air duct along a length of the strut.

9. The air duct assembly of claim 8, wherein the strut is a first strut, further including a second strut to extend between the upstream end of the air duct and the downstream end of the air duct, the second strut at least partially helically coiled in an opposite direction to the helical coiling of the first strut.

10. An air duct assembly comprising:

an air duct elongate in a longitudinal direction, the air duct including a tubular sidewall that is pliable; and a strut extending in the longitudinal direction, the strut longitudinally compressed into a curved shape when coupled to the air duct at first and second ends of the strut, the longitudinal compression of the strut to cause the tubular sidewall to be in tension.

11. The air duct assembly of claim 10, wherein the strut is a first strut, further including a second strut extending in the longitudinal direction, the second strut spaced apart from the first strut around a circumference of the air duct.

12. The air duct assembly of claim 11, wherein the first strut is helically coiled in a first direction along the circumference of the air duct, and the second strut is helically coiled in an opposing direction along the circumference of the air duct.

13. The air duct assembly of claim 10, wherein the strut is to maintain the air duct in an expanded shape when the air duct is deflated.

14. The air duct assembly of claim 10, wherein the first end of the strut is coupled to a first hoop and the second end of the strut is coupled to a second hoop, the first hoop and the second hoop extending circumferentially around the air duct.

15. The air duct assembly of claim 14, wherein the strut is to be coupled to the first hoop via a first lug extending from the first hoop and coupled to the second hoop via a second lug extending from the second hoop.

16. The air duct assembly of claim 10, wherein the strut includes at least one of aluminum, fiberglass, or steel.

17. The air duct assembly of claim 10, further including a retainer extending between the strut and the air duct.

18. The air duct assembly of claim 17, wherein the retainer is at least one of a strap, a cable, a chain, a rope, a clip, or a hook.

19. An air duct assembly, comprising:

an air duct including a pliable sidewall defining an elongate tube;

a first hoop attachable to the sidewall within air duct at a first position;

a second hoop attachable to the sidewall within air duct at a second position, the first position to be spaced apart from the second position by a distance; and a strut having a length between first and second ends that is greater than the distance, the first end to be coupled to the first hoop and the second end to be coupled to the second hoop to place the sidewall in tension.

20. The air duct assembly of claim 19, wherein the strut is to extend within an interior of the air duct when coupled to the first and second hoops.

* * * * *